US010119330B2

(12) United States Patent
Brunk et al.

(10) Patent No.: US 10,119,330 B2
(45) Date of Patent: Nov. 6, 2018

(54) HARDWIRED AND WIRELESSLY CONTROLLED MOTORIZED WINDOW SHADES SYSTEM AND METHOD OF USE

(71) Applicant: The Watt Stopper, Inc., Santa Clara, CA (US)

(72) Inventors: Darrin Brunk, Pensacola, FL (US); Brian Baisden, Pensacola, FL (US); Ben Kutell, Coral Gables, FL (US); Curtis Scott, Milton, FL (US); Sean Scalf, Pensacola, FL (US); Jon Watts, Pensacola, FL (US); Joseph Martin Ackerman, Chesapeake, VA (US)

(73) Assignee: THE WATT STOPPER INC., Santa Clara, CA (US)

( * ) Notice: Subject to any disclaimer, the term of this patent is extended or adjusted under 35 U.S.C. 154(b) by 0 days.

(21) Appl. No.: 15/266,704

(22) Filed: Sep. 15, 2016

(65) Prior Publication Data

US 2017/0081917 A1 Mar. 23, 2017

Related U.S. Application Data

(60) Provisional application No. 62/220,783, filed on Sep. 18, 2015.

(51) Int. Cl.

| | |
|---|---|
| ***A47H 1/00*** | (2006.01) |
| ***E06B 9/72*** | (2006.01) |
| ***E06B 9/44*** | (2006.01) |
| *E06B 9/68* | (2006.01) |

(52) U.S. Cl.

CPC ..... *E06B 9/72* (2013.01); *E06B 9/44* (2013.01); *E06B 2009/6809* (2013.01); *E06B 2009/6845* (2013.01); *E06B 2009/6872* (2013.01)

(58) Field of Classification Search

CPC ..... E06B 9/72; E06B 2009/6809; E06B 2009/6845; E06B 2009/6872

USPC ..... 160/241, 120

See application file for complete search history.

(56) References Cited

U.S. PATENT DOCUMENTS

| | | | | |
|---|---|---|---|---|
| 8,299,734 | B2 * | 10/2012 | Mullet | E06B 9/42 160/133 |
| 2004/0250964 | A1 * | 12/2004 | Carmen, Jr. | E06B 9/68 160/120 |
| 2006/0086874 | A1 * | 4/2006 | Habel | E06B 9/174 248/268 |
| 2008/0212294 | A1 * | 9/2008 | Ares | E06B 9/72 361/752 |
| 2009/0005911 | A1 * | 1/2009 | Decroix | E06B 9/72 700/275 |
| 2012/0173024 | A1 * | 7/2012 | Feldstein | A47H 5/0325 700/275 |

(Continued)

*Primary Examiner* — Daniel P Cahn
*Assistant Examiner* — Jeremy C Ramsey
(74) *Attorney, Agent, or Firm* — Christopher A. Proskey; BrownWinick Law Firm

(57) ABSTRACT

A hardwired and wirelessly controlled motorized window shade system is presented that includes a plurality of motorized window shades that are connected by a cable, such as Ethernet cable, to a power panel and a hardwired control. Motorized window shades are also wirelessly connected to a wireless control through a gateway. This arrangement provides the motorized window shades with the advantage of receiving power and control signals through the cable, as well as giving the flexibility of being controlled through a wireless control.

8 Claims, 21 Drawing Sheets

(56) References Cited

U.S. PATENT DOCUMENTS

| | | | | |
|---|---|---|---|---|
| 2013/0276995 | A1* | 10/2013 | Mullet | E06L 39/72<br>160/310 |
| 2014/0229184 | A1* | 8/2014 | Shires | H04L 12/12<br>704/275 |
| 2015/0362896 | A1* | 12/2015 | Feldstein | G05B 11/01<br>700/275 |
| 2016/0127530 | A1* | 5/2016 | Mullet | G06F 3/04847<br>455/557 |

* cited by examiner

HARDWIRED AND WIRELESSLY CONTROLLED MOTORIZED WINDOW SHADES SYSTEM AND METHOD OF USE

CROSS REFERENCE APPLICATION

This application claims the benefit of U.S. Provisional Application No. 62/220,783 filed Sep. 18, 2015.

FIELD OF THE INVENTION

This invention relates generally to motorized window shades. More specifically, and without limitation, this invention relates to motorized window shades that are controlled through a hardwired control as well as a wireless control.

BACKGROUND OF INVENTION

Motorized window shades are old and well known in the art. There are countless forms of motorized window shades. A number of configurations of motorized window shades are manufactured by applicant QMotion Incorporated d/b/a QMotion Advanced Shading Systems, having an address of 3400 Copter Road, Pensacola, Fla. 32514; Lutron Electronics, Inc. having an address of 7200 Suter Road, Coopersburg, Pa. 18036-1299; MechoSystems, having an address of 42-03 35th Street, Long Island City, N.Y. 11101; Somfy Systems having an address of 121 Herrod Blvd, Dayton, N.J. 08810, to name a few. Each configuration of motorized window shades has its unique advantages, and its unique disadvantages. Each configuration of motorized window shades has its own unique aesthetic appeal and operates in its own unique manner.

There are essentially two broad categories of motorized window shades, hardwired shades and battery powered shades. Hardwired shades are powered by a wired connection to an unlimited power source, such as being electrically connected to the power system that extends through the building in which the hardwired shade is installed. On the other hand, battery powered shades are powered by a limited power source, such as one or more batteries positioned within or connected to the window shade.

Hardwired shades provide the advantage of essentially never running out of power and eliminate the need to replace batteries. This convenience comes at the complexity and cost of needing to have the hardwired shade connected to a power source. This can be quite complex and expensive, requiring substantial planning before a structure is built, or substantial efforts to retrofit a preexisting structure. Another disadvantage of conventional hardwired shades is that due to the fact that they have an unlimited amount of power, their motors tend to rotate at a high rate of speed which requires a high gear ratio to reduce the speed to an aesthetically pleasing opening and closing speed for the window shade. This high gear ration creates a high level of back drive when the shade is manually moved which can eliminate the possibility of manually moving the shade or cause the gears to break when manually moved.

Alternatively, battery powered shades provide the advantage of eliminating the complexity and expense of running wires to each window shade. This convenience however comes at the cost of periodically needing to replace the batteries, and running the risk that the window shade will run out of power from time to time. Another disadvantage of battery powered window shades is that due to being battery powered extreme measures must be taken to conserve as much power as possible. One manner of conserving power is by configuring the shade to enter a sleep state after a predetermined amount of time passes without any action. When in a sleep state, the ability of the shade to detect wireless control signals can be greatly reduced. This can cause the battery powered shade to miss wireless control signals, which can be extremely frustrating to a user. Because one of the biggest advantages of battery powered window shades is that they can be installed without any connected wires, battery powered window shades are relegated being controlled by wireless control signals. That is, it would cut against the advantages provided by a battery powered motorized window shade to run wires to the battery powered window shade to control the window shade and therefore battery powered window shades come with the inherent susceptibility to missing wireless control signals.

Regardless whether the motorized window shade is battery powered or powered by an unlimited source of power, consumers prefer that their motorized window shades open or close at approximately the same speed as one another and in unison with one another. That is, when there is a plurality of motorized window shades in one room, or in view of one another, when the user presses an open or close button, it is undesirable for the motorized window shades to open at different speeds. However, due to countless variables, different motorized window shades open at different speeds. These variables include: differences in the efficiency of the motors, differences in the power levels supplied to the motors, differences between the shade materials, differences in the rotational bearings, differences between the height of the motorized window shades, differences between the width of the motorized window shades, among countless other variables.

To complicate matters further, different consumers desire their shades to open at different speeds. That is, what one consumer may consider the perfect opening or closing speed, another consumer may consider too fast or too slow.

Therefore, for the reasons stated above, and for other reasons stated below which will become apparent to those skilled in the art upon reading and understanding the specification, drawings and claims there is a need in the art for an improved motorized window shade system and method of use.

Thus, an object of the invention is to provide an improved motorized window shade system and method of use that improves upon the present state of the art.

Another object of the invention is to provide an improved motorized window shade system and method of use that provides some of the advantages hardwired motorized window shades and some of the advantages of battery powered window shades while not suffering from some of the disadvantages of hardwired motorized window shades and some of the disadvantages of battery powered window.

Yet another object of the invention is to provide an improved motorized window shade system and method of use that allows for adjusting the opening and closing speed.

Another object of the invention is to provide an improved motorized window shade system and method of use that allows for hardwired control as well as wireless control.

Yet another object of the invention is to provide an improved motorized window shade system and method of use that facilitates balancing the speed of bottom bars of multiple shades.

Another object of the invention is to provide an improved motorized window shade system and method of use that allows a user to speed the opening or closing speed.

Yet another object of the invention is to provide an improved motorized window shade system and method of use that allows a user to slow the opening or closing speed.

Another object of the invention is to provide an improved motorized window shade system and method of use that varies the opening or closing speed in an efficient manner.

Yet another object of the invention is to provide an improved motorized window shade system and method of use that allows for balancing the bottom bar speed of motorized window shades having varying widths.

Another object of the invention is to provide an improved motorized window shade system and method of use that allows for balancing the bottom bar speed of motorized window shades having varying heights.

Yet another object of the invention is to provide an improved motorized window shade system and method of use that allows for balancing the bottom bar speed of motorized window shades having varying gear ratios.

Another object of the invention is to provide an improved motorized window shade system and method of use that allows for balancing the bottom bar speed of motorized window shades having varying motors.

Yet another object of the invention is to provide an improved motorized window shade system and method of use that allows for balancing the bottom bar speed of motorized window shades having varying power sources.

Another object of the invention is to provide an improved motorized window shade system and method of use that allows for balancing the bottom bar speed of motorized window shades without substantially reducing battery life.

Yet another object of the invention is to provide an improved motorized window shade system and method of use that is easy to use.

Another object of the invention is to provide an improved motorized window shade system and method of use allows for manual movement of the shade.

Yet another object of the invention is to provide an improved motorized window shade system and method of use is relatively inexpensive.

Another object of the invention is to provide an improved motorized window shade system and method of use that is convenient to use.

Yet another object of the invention is to provide an improved motorized window shade system and method of use that is easy to install.

Another object of the invention is to provide an improved motorized window shade system and method of use that is energy efficient.

Yet another object of the invention is to provide an improved motorized window shade system and method of use that has a simple design.

Another object of the invention is to provide an improved motorized window shade system and method of use that allows for power and control signals to be transmitted through a single cable.

Yet another object of the invention is to provide an improved motorized window shade system and method of use that uses standard wiring.

Another object of the invention is to provide an improved motorized window shade system and method of use that uses standard connections.

Yet another object of the invention is to provide an improved motorized window shade system and method of use that has a rugged design.

Another object of the invention is to provide an improved motorized window shade system and method of use allows for use of a wireless control as well as a hardwired control.

Yet another object of the invention is to provide an improved motorized window shade system and method of use that has an intuitive design.

Another object of the invention is to provide an improved motorized window shade system and method of use reduces the cost of installation over standard hardwired shades.

Yet another object of the invention is to provide an improved motorized window shade system and method of use that can be controlled through the internet.

Another object of the invention is to provide an improved motorized window shade system and method of use that can be connected to a security system or home automation system.

Yet another object of the invention is to provide an improved motorized window shade system and method of use that provides two-way wireless communication.

Another object of the invention is to provide an improved motorized window shade system and method of use that reduces or eliminates missed wireless control signals.

These and other objects, features, or advantages of the invention will become apparent from the specification and claims.

SUMMARY OF THE INVENTION

A hardwired and wirelessly controlled motorized window shade system is presented that includes a plurality of motorized window shades that are connected by a cable, such as Ethernet cable, to a power panel and a hardwired control. Motorized window shades are also wirelessly connected to a wireless control through a gateway. This arrangement provides the motorized window shades with the advantage of receiving power and control signals through the cable, as well as giving the flexibility of being controlled through a wireless control.

DETAILED DESCRIPTION OF THE INVENTION

Figure 1:
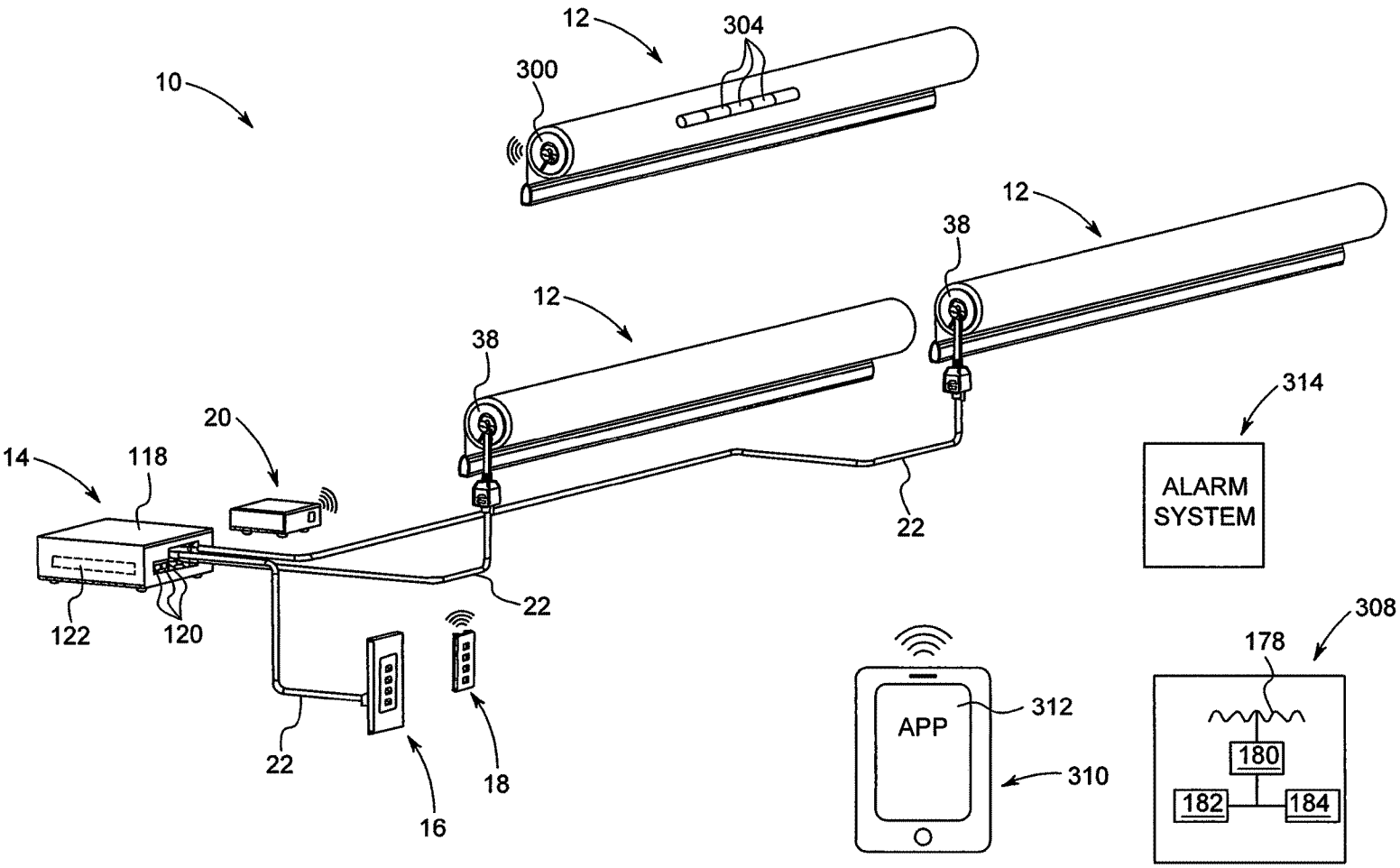
FIG. 1 is a perspective view of an improved motorized window shade system, the view showing the a plurality of motorized window shades electrically connected to a power panel, a hardwired control electrically connected to the power panel, a wireless remote wirelessly connected to a gateway, the gateway wirelessly connected to the plurality of motorized window shades.
Figure 2:
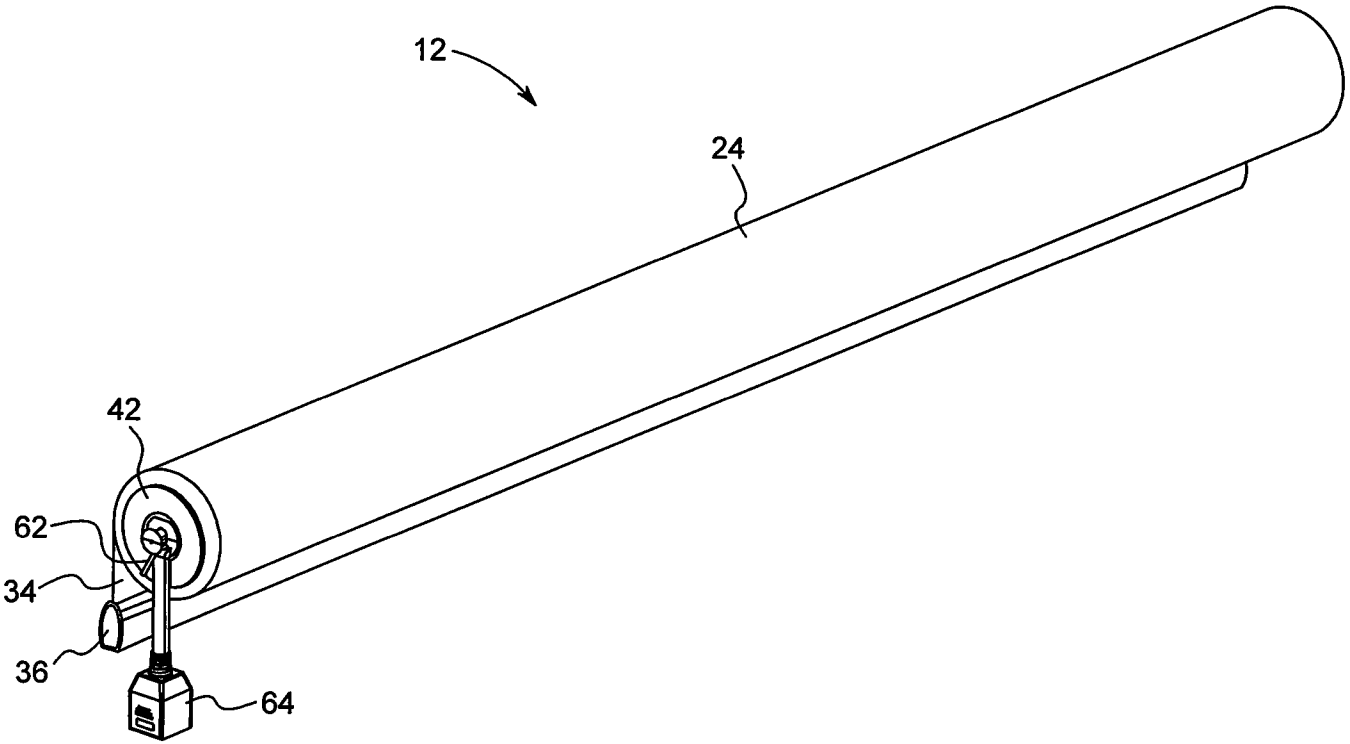
FIG. 2 is a perspective view of a motorized window shade of FIG. 1, the view showing the axle, cable and antenna extending out of an end of the motorized window shade.
Figure 3:
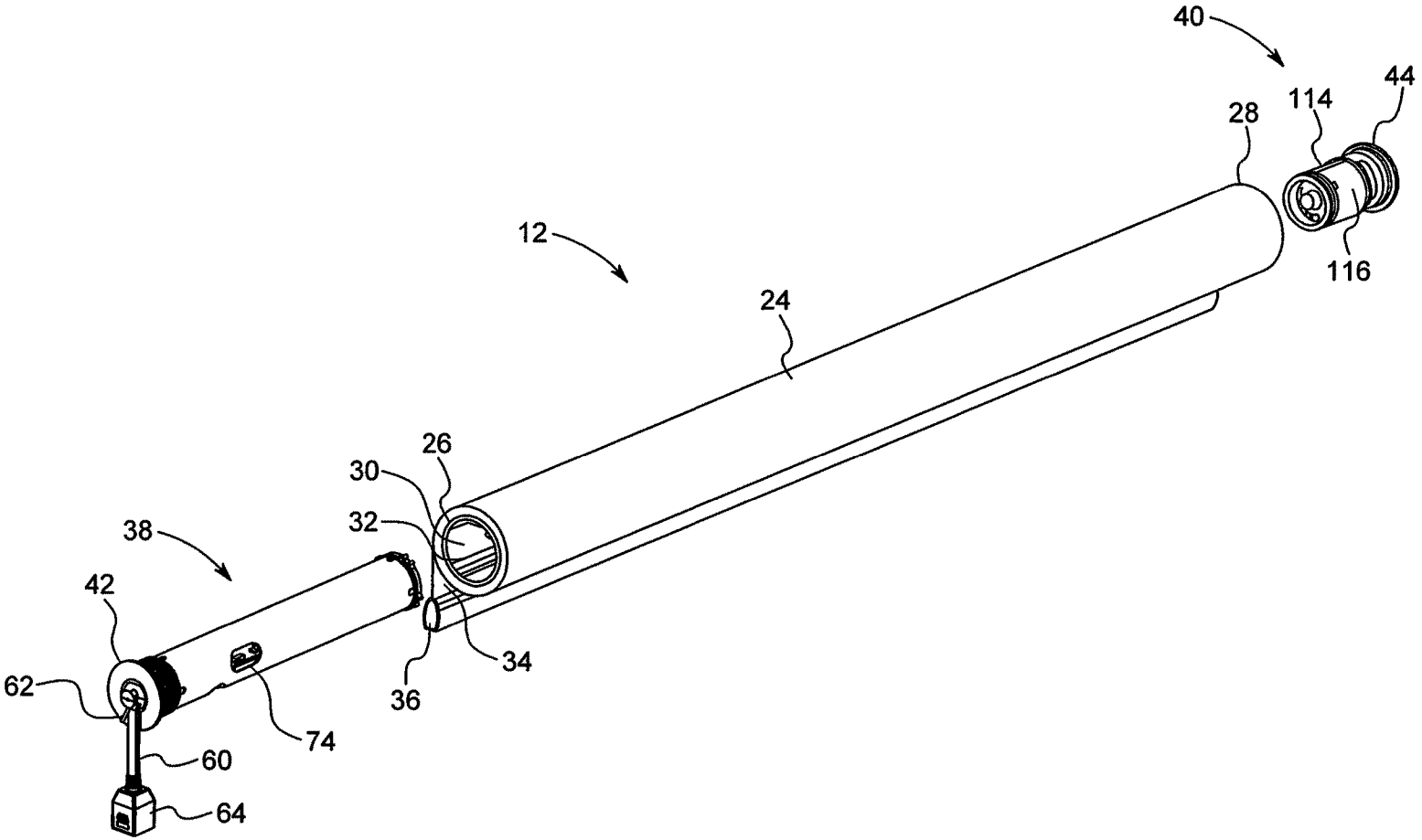
FIG. 3 is an exploded perspective view of the motorized window shade of FIG. 2, the view showing the motor controller assembly removed from one end of the roller tube, and the counterbalance assembly removed from the other end of the roller tube.
Figure 4:
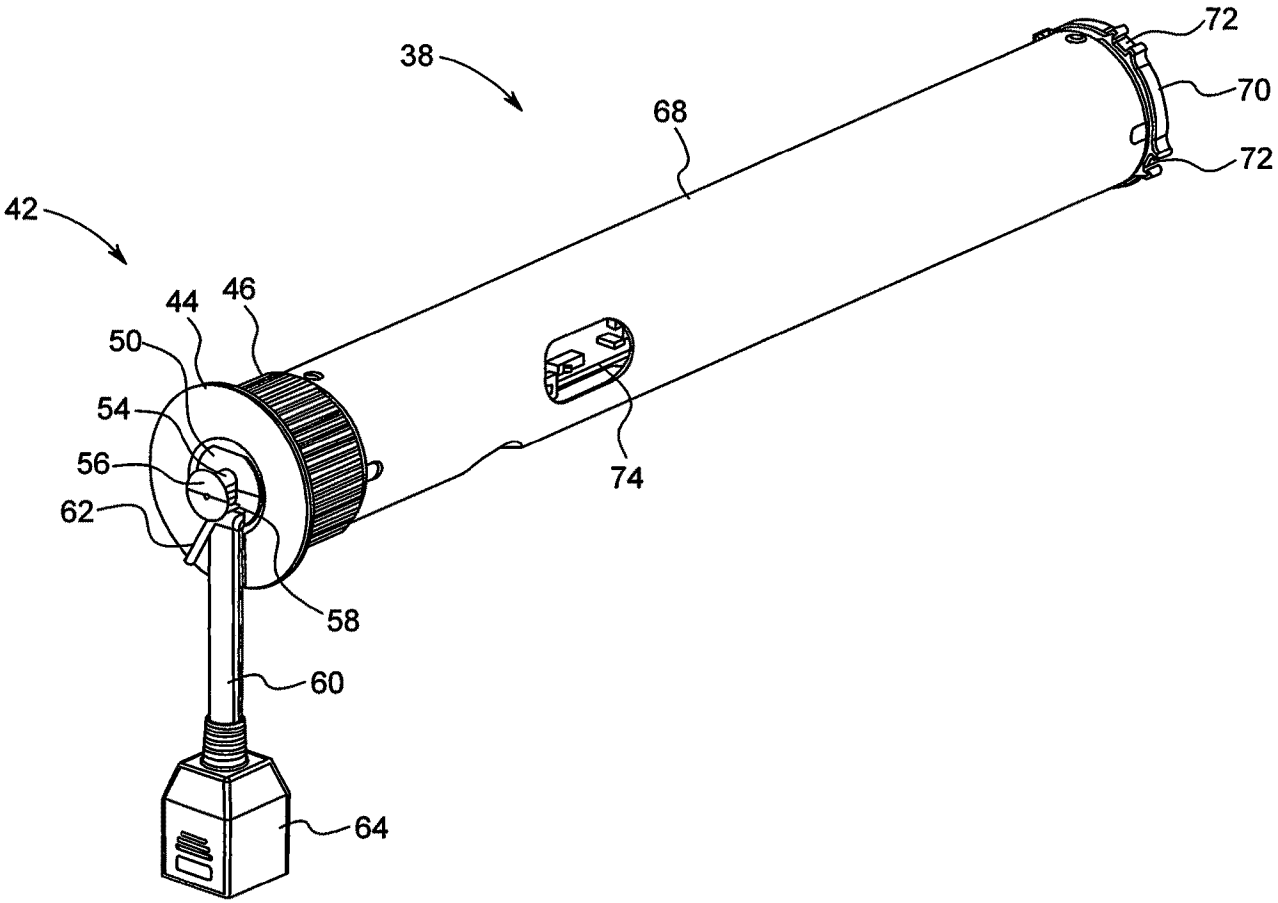
FIG. 4 is a perspective view of the motor controller assembly of 3, the view showing the axle, cable and antenna extending out of one end, and a drive wheel rotatably connected to the opposite end.
Figure 5:
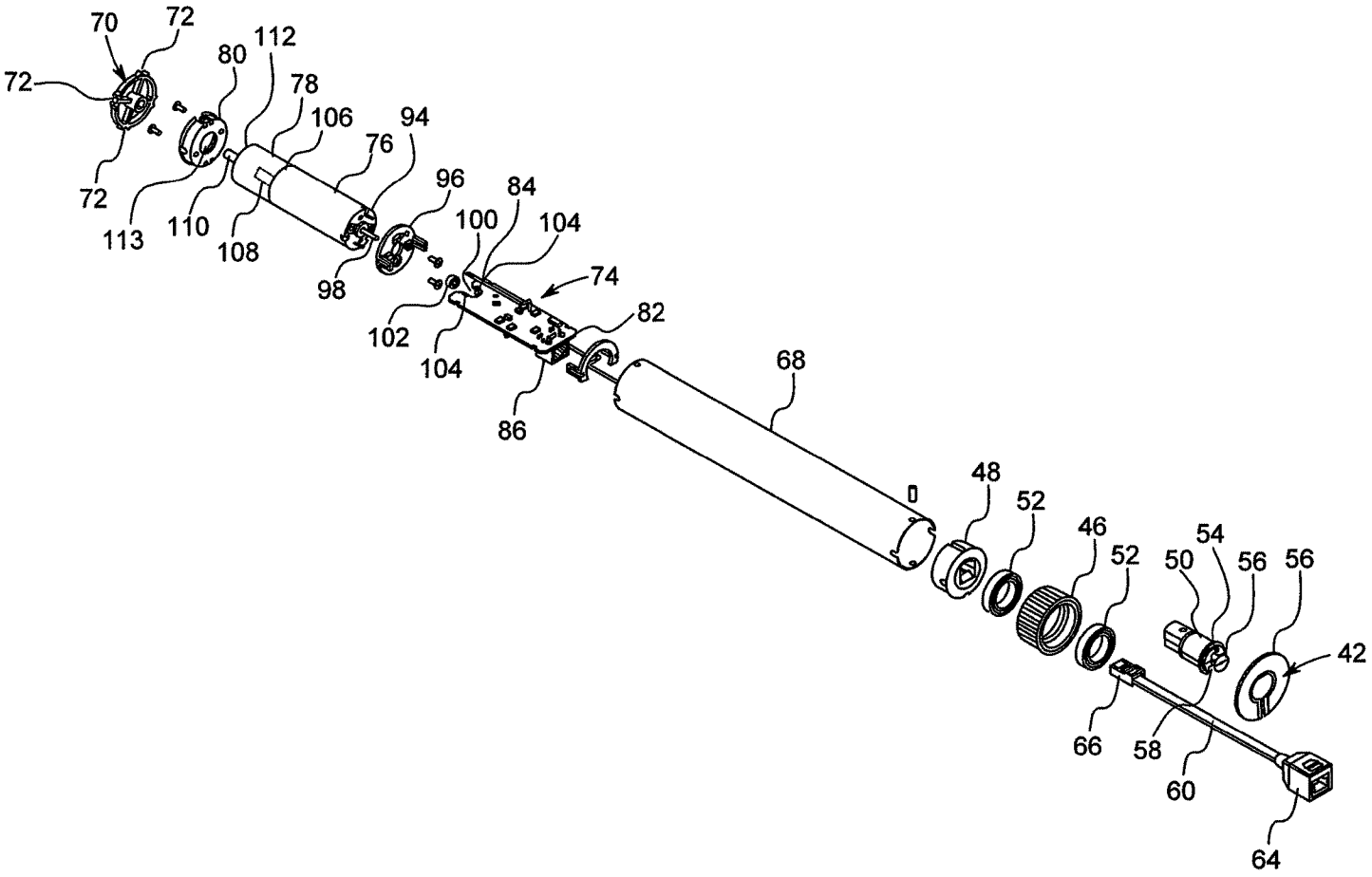
FIG. 5 is an exploded perspective view of the motor controller assembly of FIG. 4.
Figure 6:
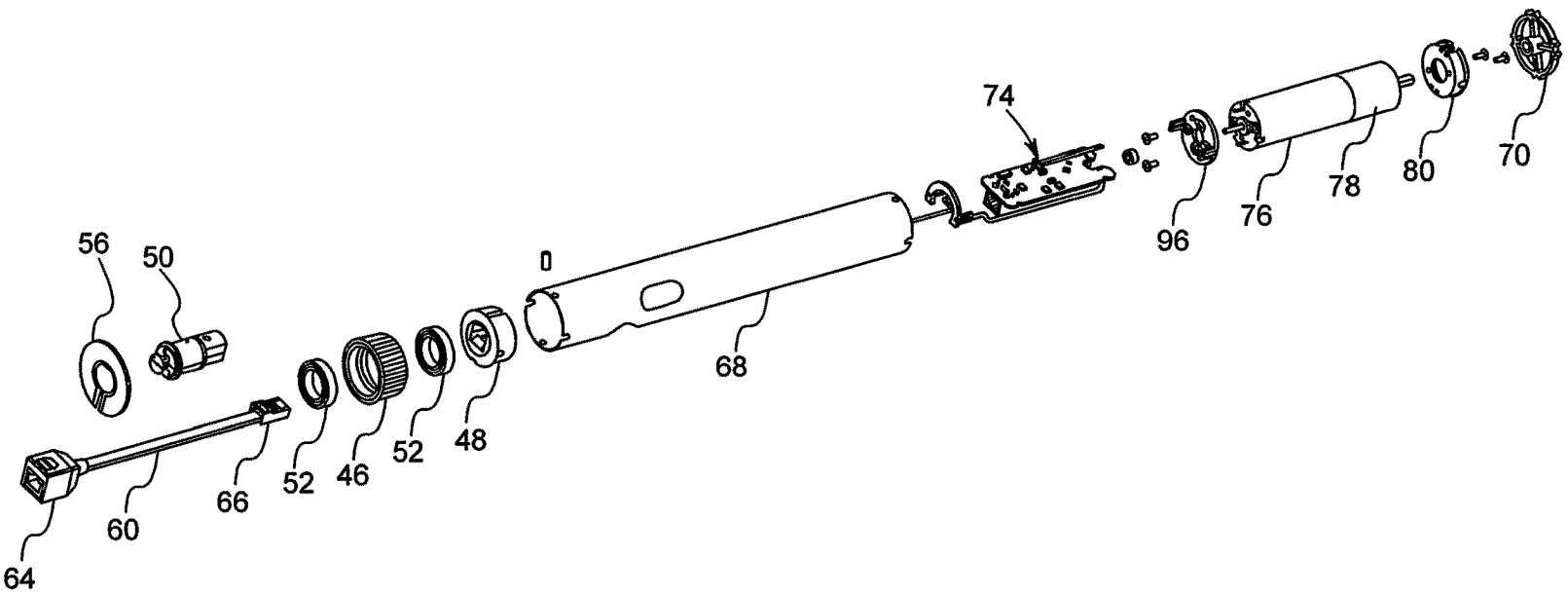
FIG. 6 is an exploded perspective view of the motor controller assembly of FIG. 4.
Figure 7:
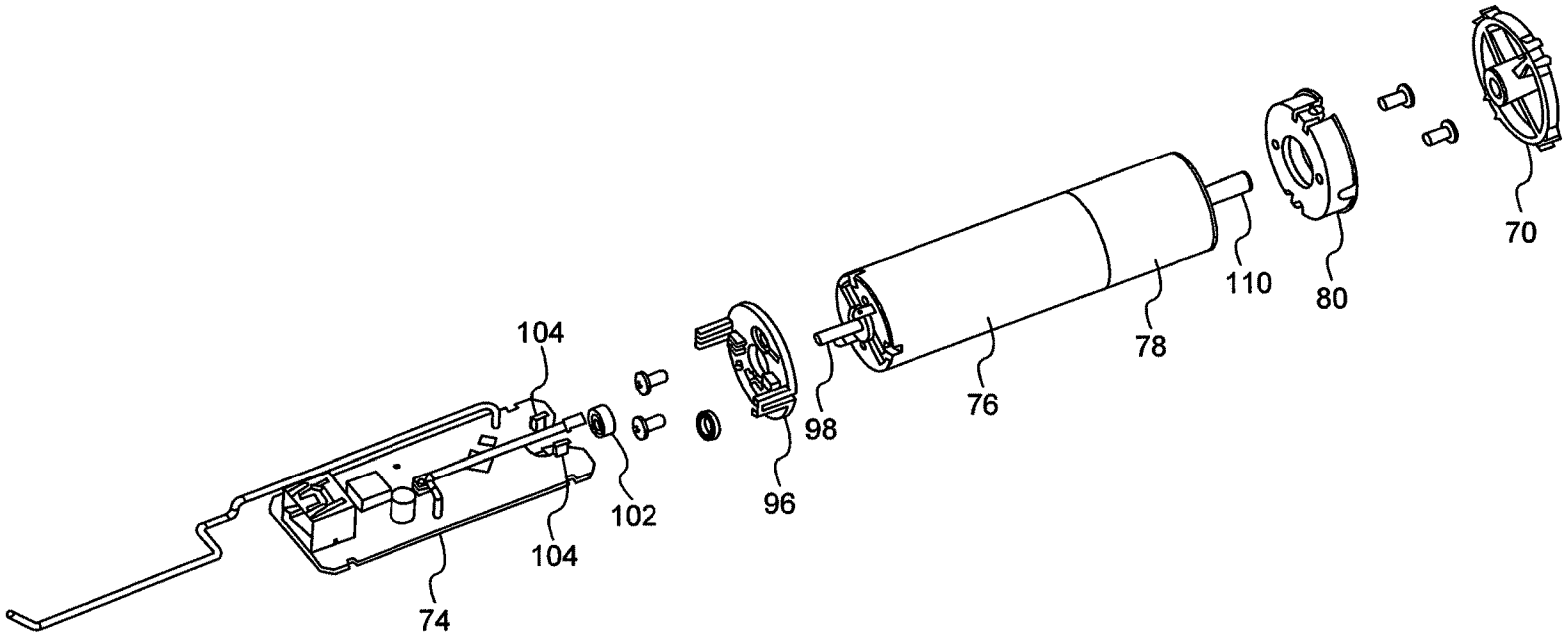
FIG. 7 is an exploded perspective view of the printed circuit board, motor, gear box and drive wheel of the motor controller assembly of FIG. 6.
Figure 8:
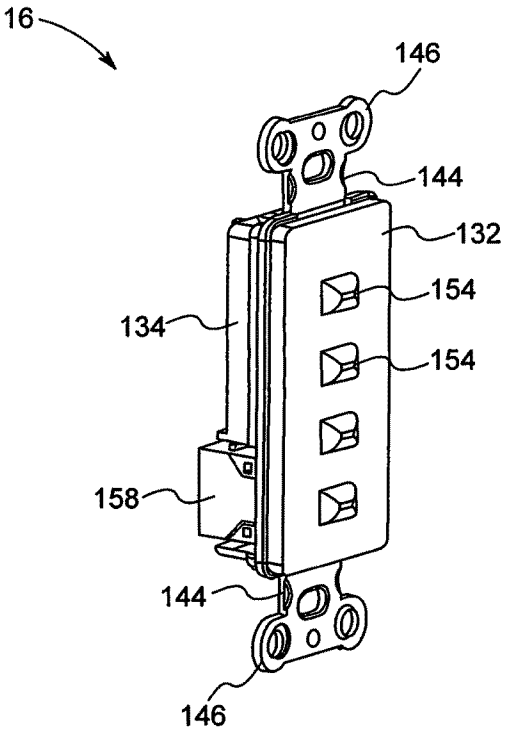
FIG. 8 is a perspective view of a hardwired control of FIG. 1.
Figure 9:
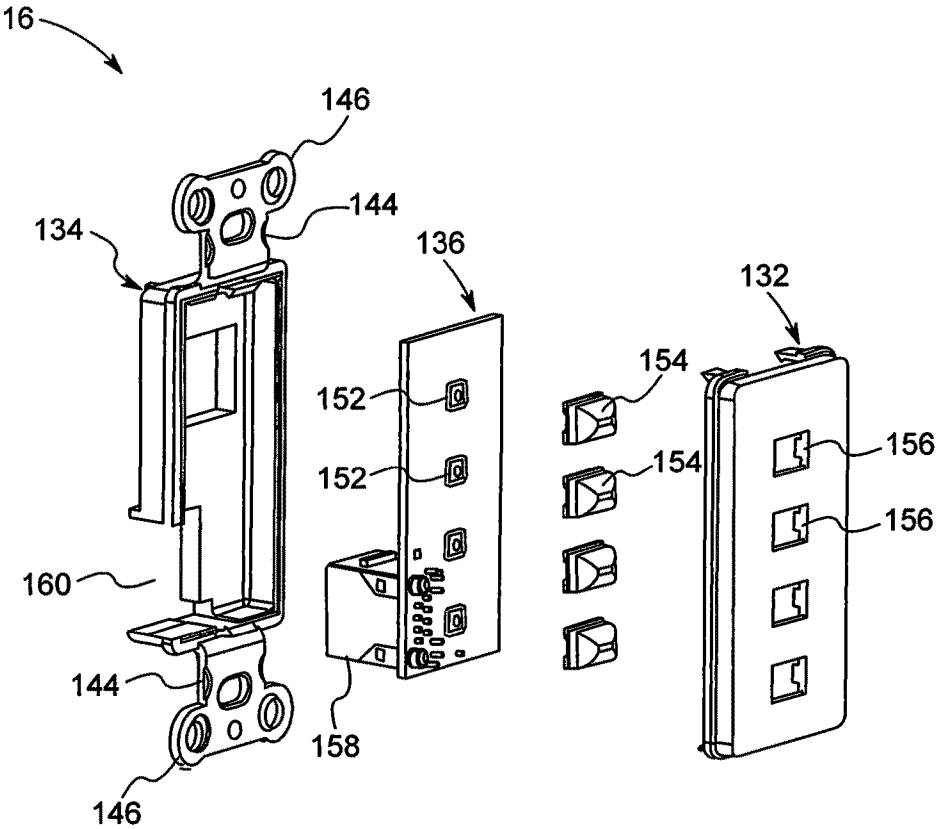
FIG. 9 is a front exploded perspective view of the hardwired control of FIG. 8.
Figure 10:
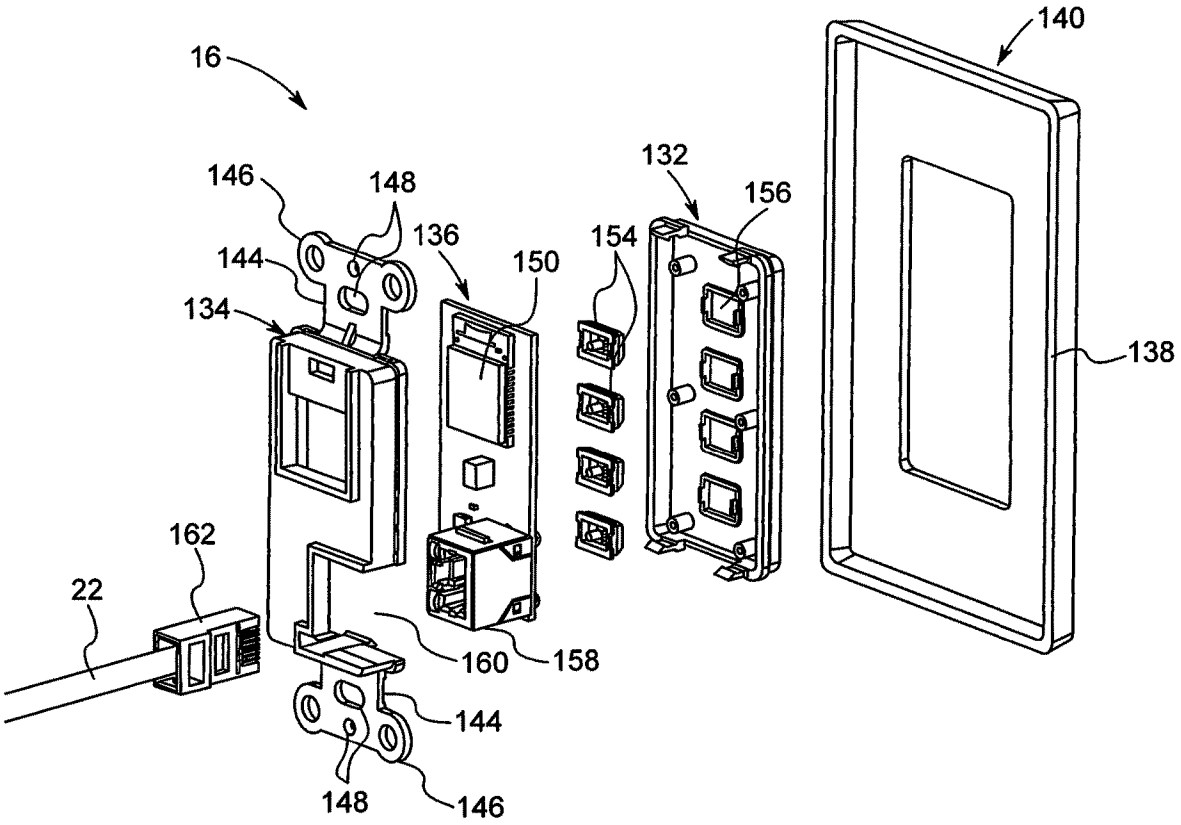
FIG. 10 is a rear exploded perspective view of the hardwired control of FIG. 8.
Figure 11:
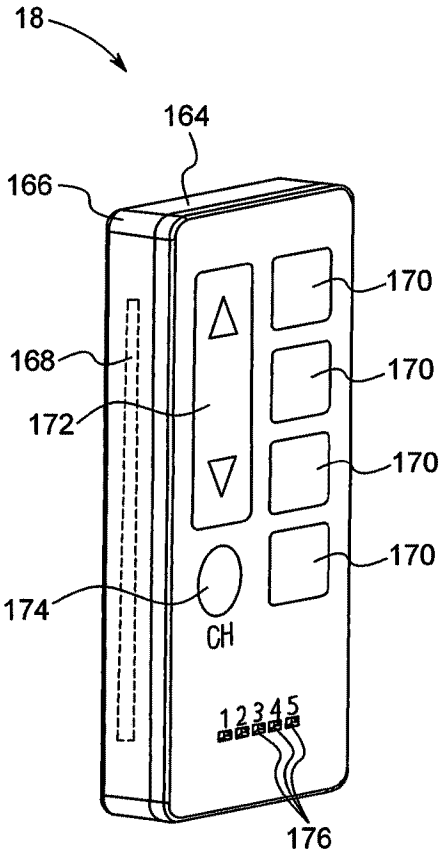
FIG. 11 is a perspective view of the wireless control of FIG. 1.
Figure 12:
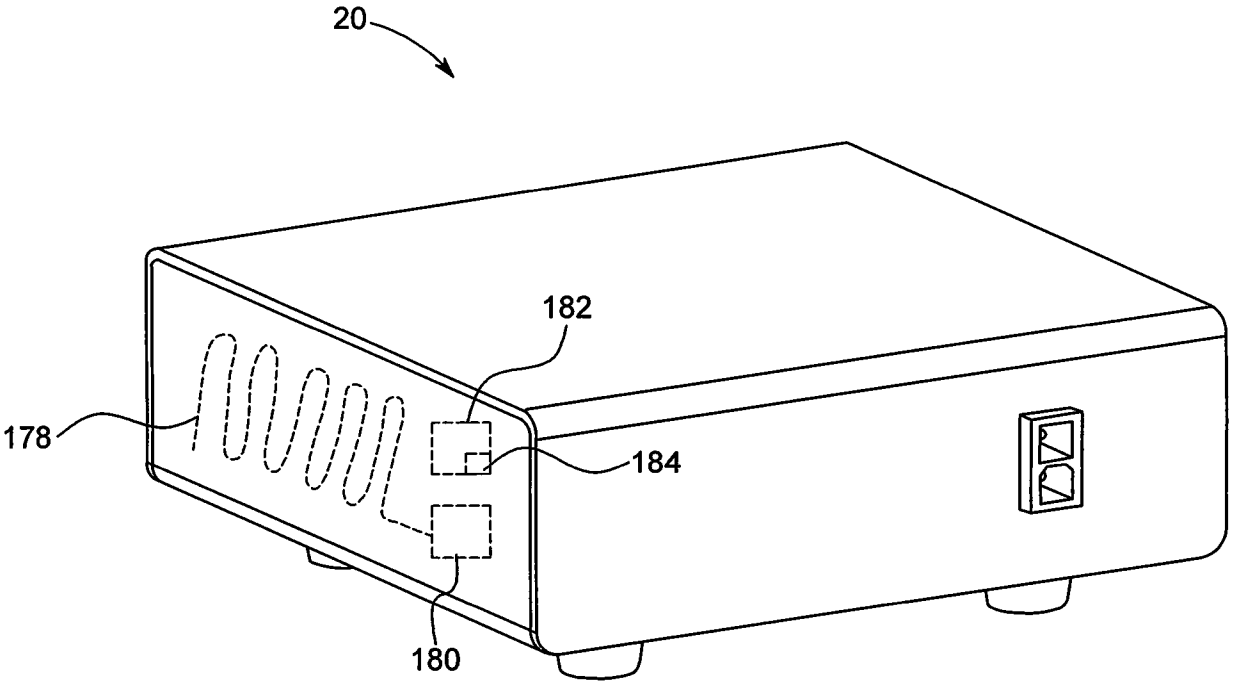
FIG. 12 is a perspective view of a the gateway of FIG. 1.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the invention(s). The following detailed description is, therefore, not to be taken in a limiting sense, and the scope of the invention is defined only by the appended claims, along with the full scope of equivalents to which such claims are entitled.

As used herein, the terminology such as vertical, horizontal, top, bottom, front, back, end and sides are referenced according to the views presented. It should be understood, however, that the terms are used only for purposes of description, and are not intended to be used as limitations. Accordingly, orientation of an object or a combination of objects may change without departing from the scope of the invention.

In addition, while the system presented herein is shown and described primarily with reference to a motorized roller shade, the system is not limited to use with roller shades. Instead, it is hereby contemplated that the system can be used with type of motorized window shade, such as a honeycomb shade, a Venetian shade, a plantation shade, a roman shade, a vertical shade, a drapery track system, a drapery rod system or the like. Furthermore, it is hereby contemplated that the system can be used with any applicable mechanical device.

With reference to the Figures, a hardwired and wirelessly controlled motorized window shade system and method of use is presented with reference to reference numeral 10 (system 10). The system 10 is formed of any suitable size, shape, design and configuration. In one arrangement, as is shown, the system 10 includes a plurality of motorized window shades 12, a power panel 14, a hardwired control 16, a wireless control 18 and a gateway 20. In the arrangement shown, motorized window shades 12 are connected to power panel 14 by cable 22 and hardwired control 16 is connected to power panel by cable 22.

Motorized Window Shade:

Motorized window shade 12 is formed of any suitable size, shape and design. In the arrangement shown, motorized window shade 12 is what is known as a roller shade, however any other form of a motorized window shade is hereby contemplated for use such as a honeycomb shade, a venetian shade, a plantation shade, a roman shade, a vertical shade, a drapery track system, a drapery rod system or the like. In the arrangement shown, as one example, motorized window shade 12 is formed of an elongated roller tube 24 that extends a length from a first end 26 to a second end 28. Roller tube 24 is generally cylindrical in shape and includes a hollow interior 30 that extends from first end 26 to second end 28 in an extrusion-like fashion. A plurality of features 32 are positioned within the hollow interior 30 of roller tube 24 and extend all or a portion of the way from first end 26 to second end 28. In one arrangement, as is shown, features 32 are a plurality of rails or ridges that extend outward into the hollow interior 30 of roller tube 24. However, in an alternative arrangement, features may be formed of grooves or any other form of a protrusion or recess in the interior surface of the hollow interior 30 of roller tube 24.

Shade material 34 is connected at an upper end to the exterior surface of roller tube 24 and is connected at a lower end to a bottom bar 36. Shade material 36 wraps around the exterior surface of roller tube 24. As the roller tube 24 is rotated in a first direction, the bottom bar 36 and shade material 34 is wrapped around the roller tube 24 and is raised; as the roller tube 24 is rotated in a second direction, the bottom bar 36 and shade material 34 is unwrapped from the roller tube 24 and is lowered. A motor controller assembly 38 is positioned in one open end of the roller tube 24 and a counterbalance assembly 40 is positioned in the other open end of the roller tube 24.

Again, however, any other form of a shade is contemplated for use.

Motor Controller Assembly:

Motor controller assembly 38 is formed of any suitable size, shape and design and serves to raise and lower the shade material 34 on command. In the arrangement shown, as one example, motor controller assembly 38 extends in a generally cylindrical manner from an exterior end to an interior end. An end cap 42 is positioned at the exterior end and includes a flange 44 that has a larger diameter than the other portions of motor controller assembly 38. Flange 44 serves to provide a stop when motor controller assembly 38 is inserted within the hollow interior 30 of roller tube 24.

End cap 42 includes an exterior collar 46 and an interior collar 48 that surround an axle 50 that is generally centrally positioned within end cap 42 and one or more bearings 52. End cap 42 supports the end of the window shade 12 by connection of axle 50 to a bracket while allowing for rotation of roller tube 24 while the other components of motor controller assembly 38 remain stationary. The exterior surface of exterior collar 46 includes serrations or other features that frictionally or matingly engage the interior surface of the hollow interior 30 of the roller tube 24 thereby providing support and engagement between these two components while allowing rotation thereof.

Axle 50 includes a support shaft 54 that extends a distance outward from flange 44, or outward from the end or shade 12 and terminates in a flange 56, that is wider than support shaft 54. In the arrangement shown, shaft 54 is formed of a non-round shape. As one example, as is shown, shaft 54 has a rounded upper surface and a rounded lower surface with elongated straight walls that extend between the upper rounded end and the lower rounded end; however any other non-round shape is hereby contemplated for use such as square, rectangular, triangular, heptagonal, hexagonal, octagonal or the like. The non-round shape of support shaft 54 is received within a mating or similarly shaped slot, feature or opening in a bracket such that when support shaft 54 is received within the bracket the axle 50 is prevented from rotating, while exterior collar 46 is able to rotate on bearings 52. Once support shaft 54 is inserted within the slot or opening of the bracket, flange 56 prevents the support shaft 54 from unintentionally pulling out.

Axle 50 also includes a recess 58 therein that provides access for cable 60 to extend through end cap 42 and into the motor controller assembly 38. Recess 58 also provides access for antenna 62 to extend through end cap 42 and into the motor controller assembly 38.

Cable 60 is formed of any suitable size, shape and design of a cable, wire or the like that is capable of carrying power to the motor controller assembly 38 as well as wired control signals. In one arrangement as is shown, cable 60 is a generally flat 8-wire cable, such as an Ethernet cable, or other Ethernet cable such as CAT5, CAT5e, CAT6 or the like, or similar multi-wire cable that is capable of carrying power as well as control signals.

The exterior end of cable 60 includes a socket 64 and the interior end of cable 60 includes a plug 66. In one arrangement, as is shown, socket 64 is sized and shaped to receive a standard Ethernet plug, and plug 64 is itself a standard Ethernet plug.

Antenna 62 is formed of any suitable size, shape or design and serves to receive wireless control signals and transmit them to the motor controller assembly 38. In the arrangement shown, as one example, antenna 62 is a simple mono pole antenna that extends outward from axle 50 and hangs down a short distance however any other form of an antenna is hereby contemplated for use such as a loop antenna, a fractal antenna, a slot antenna, a coil antenna, a telescoping antenna, or the like.

A housing 68 is connected to the inward end of end cap 42 and extends a distance before terminating before drive wheel 70. Housing 68 is formed of any suitable size, shape and design and serves to protect the other components of motor controller assembly 38. In the arrangement shown, as one example, housing 68 is a generally cylindrical hollow tube that is sized and shaped to fit within the hollow interior 30 of roller tube 24 within close tolerances but without contact.

Drive wheel 70 is connected to the inward end of motor controller assembly 38 and serves to engage the features 32 on the interior surface of roller tube 24 and rotate roller tube 24. To facilitate this functionality, the exterior periphery of drive wheel 70 itself includes features 72 that are sized and shaped to engage, receive and/or mate with the features 32 on the interior surface of roller tube 24. In the arrangement shown, where the feature 32 on the interior surface of roller tube 24 are rails that extend the length of the roller tube 24 the features 72 in the exterior surface of the drive wheel 70 are grooves or slots that mate with the rails. This arrangement allows drive wheel 70 to be inserted into an end of the roller tube 24 and slide along a length of the roller tube 24 while allowing the drive wheel 70 to rotate roller tube 24.

Housing 68 connects to the inward end of end cap 42 and contains the other components of motor controller assembly 38 including printed circuit board 74 (PCB 74), motor 76, gear box assembly 78 and cover 80 before terminating before drive wheel 70.

Printed circuit board 74 (PCB 74) is formed of any suitable size, shape and design and serves to house, hold, connect and interconnect the electronic components of the motor controller assembly 38. In one arrangement, as is shown, PCB 74 is formed of a single, generally elongated, rectangular board that extends a length between an interior end 82 and an exterior end 84. However any other shaped board, or multiple boards are hereby contemplated for use.

A socket 86 is connected at or near the interior end 82. Socket 86 is formed of any suitable size, shape and design. In the arrangement shown, socket 86 is formed to receive a standard Ethernet plug, such as plug 66 shown on the interior end of cable 60, however any other form of a plug/socket arrangement is hereby contemplated for use. Socket 86 serves to connect cable 60, and the wires therein, to the components of PCB 74. Namely, socket 86 transmits power and control signals to and from PCB 74.

PCB 74 also includes a microprocessor 88 and memory 90. Any form of a microprocessor and memory is hereby contemplated for use. Microprocessor 88 serves to process information and output commands according to instructions or software stored in memory 90. Memory 90 is any form of an information storage device such as flash, ram, dram, a hard drive or the like. In this way, microprocessor 88 controls motor 76 in the manner identified by instructions or software stored in memory 90. In one arrangement, microprocessor 88 and memory 90 are formed of a single combined package. In another arrangement microprocessor 88 and memory 90 are formed of separate devices or multiple devices. Alternatively microprocessor 88 may be formed of multiple separate devices and/or memory 90 may be formed of multiple separate devices that when connected or combined cooperate to provide the function of controlling motor 76 in the desired manner.

In one arrangement, microprocessor 88 with memory 90 is an EM358x High-Performance, Integrated ZigBee/802.15.4 System-on-Chip Family manufactured by Silicon Laboratories. As stated by the manufacturer:

> The Ember EM358x is a fully integrated System-on-Chip that integrates a 2.4 GHz, IEEE 802.15.4-2003-compliant transceiver, 32-bit ARM® Cortex™-M3 microprocessor, flash and RAM memory, and peripherals of use to designers of ZigBee-based systems.

The transceiver uses an efficient architecture that exceeds the dynamic range requirements imposed by the IEEE 802.15.4-2003 standard by over 15 dB. The integrated receive channel filtering allows for robust co-existence with other communication standards in the 2.4 GHz spectrum, such as IEEE 802.11-2007 and Bluetooth. The integrated regulator, VCO, loop filter, and power amplifier keep the external component count low. An optional high performance radio mode (boost mode) is software-selectable to boost dynamic range.

The integrated 32-bit ARM® Cortex™-M3 microprocessor is highly optimized for high performance, low power consumption, and efficient memory utilization.

Including an integrated MPU, it supports two different modes of operation—privileged mode and user mode. This architecture could allow for separation of the networking stack from the application code, and prevents unwanted modification of restricted areas of memory and registers resulting in increased stability and reliability of deployed solutions.

The EM358x has either 256 or 512 kB of embedded flash memory and either 32 or 64 kB of integrated RAM for data and program storage. The Ember software for the EM358x employs an effective wear-leveling algorithm that optimizes the lifetime of the embedded flash.

To maintain the strict timing requirements imposed by the ZigBee and IEEE 802.15.4-2003 standards, the EM358x integrates a number of MAC functions, AES128 encryption accelerator, and automatic CRC handling into the hardware. The MAC hardware handles automatic ACK transmission and reception, automatic backoff delay, and clear channel assessment for transmission, as well as automatic filtering of received packets. The Ember Packet Trace Interface is also integrated with the MAC, allowing complete, non-intrusive capture of all packets to and from the EM358x with Ember development tools.

The EM358x offers a number of advanced power management features that enable long battery life. A high-frequency internal RC oscillator allows the processor core to begin code execution quickly upon waking. Various deep sleep modes are available with less than 2 μA power consumption while retaining RAM contents. To support user-defined applications, on-chip peripherals include optional USB, UART, SPI, TWI, ADC, and general-purpose timers, as well as up to 24 GPIOs. Additionally, an integrated voltage regulator, power-on-reset circuit, and sleep timer are available.

Finally, the EM358x utilizes standard Serial Wire and JTAG interfaces for powerful software debugging and programming of the ARM Cortex™-M3 core. The EM358x integrates the standard ARM® system debug components: Flash Patch and Breakpoint (FPB), Data Watchpoint and Trace (DWT), and Instrumentation Trace Macrocell (ITM) as well as the advanced Embedded Trace Macrocell (ETM).

However, any other suitable microprocessor is hereby contemplated for use. Microprocessor 88 receives control signals from hardwired control 16 through cable 60 and socket 86. Simultaneously, PCB 74 and the components thereof receives power from power panel 14 through cable 60 and socket 86.

Antenna 62 is connected to a radio 92. Radio 92 is any form of a device which receives wireless control signals from antenna 62, filters the wireless control signals, processes them into a usable form and then forwards on the processed signals as output to microprocessor 88. When radio 92 is a 1-way device, meaning it facilitates one-way communication, meaning it only receives signals from antenna 62 and forwards them on to microprocessor 88, radio 92 is known as a receiver. When radio 92 a 2-way device, meaning it facilitates two-way communication, meaning it not only receives signals from antenna 62 and forwards them on to microprocessor 88 but also receives signals from microprocessor 88 and processes them and transmits or broadcasts them through antenna 62, radio 92 is known as a transceiver.

The exterior end 84 connects to the interior end 94 of motor 76. In one arrangement, a connector 96 is positioned between the PCB 74 and motor 76 that helps to facilitate connection between the two components. A drive shaft 98 extends outward from the interior end 94 of motor 76 and into a recess 100 formed in PCB 74. A magnet or magnetic wheel 102 is connected to drive shaft 98, as the drive shaft 98 rotates so rotates magnetic wheel 102. A pair of sensors 104 are positioned adjacent recess 100, magnetic wheel 102 and drive shaft 98. As drive shaft 98 rotates, so rotates magnetic wheel 102 within recess 100, as magnetic wheel 102 rotates, sensors 104 sense the passing magnetic fields and transmits these signals to microprocessor 88 which counts these fields or ticks. From this information, the total number of fields or ticks can be determined between a fully open position and a fully closed position. Also from this information, the position of the bottom bar 36 can be determined at all times. As an example, if there are 1,000 ticks between a fully open and fully closed position and the microprocessor 88 detects that the motor 76 has rotated 500 ticks or counts from a fully open or fully closed position, the microprocessor 88 recognizes that the bottom bar 36 is at a 50% open position. In this way, the microprocessor 88 using magnet 102 and sensors 104 can track the position of the shade 12.

Sensors 104 can be any form of a sensor such as a mechanical sensor, an optical sensor, a magnetic sensor or any other form of a sensor that detects motion and/or rotation of motor 76, drive shaft 98 and/or wheel 102. In one arrangement, as is shown, sensors 104 are a pair of Hall Effect sensors that detect the passing magnetic fields of magnetic wheel 102.

The exterior end 106 of motor 76 is connected to gear box assembly 78. More specifically, a drive shaft 108 that extends outward from the exterior end 106 of motor 76 connects to gear box assembly 78. In one arrangement, drive shaft 98 that extends out of the interior end 94 of motor 76 and drive shaft 98 that extends out of the exterior end 106 of motor 76 are one unitary drive shaft and rotate in unison with one another. Gear box assembly 78 reduces the number of rotations of drive shaft 98, 108 to a more suitable speed. That is, motor 76 tends to rotate at a speed higher than the desired open or close speed of bottom bar 36. As such, gear box assembly 78 causes the output shaft 110 connected to driveshaft 98, 108 by gearbox assembly 78 to rotate more times than revolutions of roller tube 24. This gear reduction can be in the range of 10-to-1 to 200-to-1, or more specifically 20-to-1 to 80-to-1, and more specifically, depending on the particulars of the configuration of motor 76 and the amount of power provided to motor 76, examples of gear box assembly include approximately 22-to-1, 42-to-1 and 73-to-1 gear ratios that have been tested with success and provide an aesthetically pleasing open and close speed.

By providing a low amount of power to motor 76, this causes motor 76 to rotate relatively slowly, this causes gear ratio of gear box assembly 78 to be lower, which reduces back drive when the shade material 34 or bottom bar 36 are manually moved, which allows for the shade material 34 and bottom bar 36 to be manually moved without breaking the gears of gear box assembly 78. This also allows the microprocessor 88 to track the position of the bottom bar 36 by sensors 104 when manually moved such that the microprocessor 88 constantly is aware of the present position of the bottom bar 36 and shade material 34. Because the magnetic wheel 102 is connected to the end of drive shaft 98 that is not gear reduced, this provides a high level of precision and allows for tracking of the position of the shade with tight error bands. In addition, this allows microprocessor 88 to be programmed to respond to a tug. That is, when the bottom bar 36 is moved by less than a predetermined displacement (a micro-tug) the microprocessor 88 detects this displacement and responds by moving the bottom bar 36 to the next intermediate position above the current position of the bottom bar 36 (such as 75% open, 50% open, 25% open or 100% open or the like); or if the bottom bar 36 is moved by more than a predetermined displacement but less than a maximum displacement (a full tug or just tug) the microprocessor 88 detects this displacement and responds by moving the bottom bar 36 to the full open position; or if the bottom bar is moved by more than a maximum displacement (a manual movement) the microprocessor 88 detects this displacement and responds by merely tracking the current position of the bottom bar 36 and not responding with a movement, thereby allowing the user to move the bottom bar 36 to their desired location.

In one arrangement, the gears of gear box assembly 78 are formed of a metallic material which provides superior strength and wear resistance. In an alternative arrangement, some or all of the gears are formed of a non-metallic material such as plastic, PVC, Nylon, composite or the like which tends to be quieter at the cost of some strength and wear resistance. However, to improve strength and wear resistance, the non-metallic gears are elongated or lengthened to provide additional surface area which provides greater strength and wear resistance for the plastic components.

An output shaft 110 extends outward from the exterior end 112 of gear box assembly 78. Output shaft 110 rotates at a reduced speed as compared to drive shaft 98, 108 due to the gear reduction of gear box assembly 78. Output shaft 110 extends through an opening 113 in cover 80 and connects to drive wheel 70. In this way, output shaft 110 rotates drive wheel 70 which rotates roller tube 24.

Regardless of whether microprocessor 88 receives control signals from radio 92 or through cable 22, microprocessor 88 processes these signals according to software and instructions stored in memory 90 and outputs them to control operation of motor 76. In one arrangement, as is shown, this output is transmitted to motor drive circuit 91 which controls operation of motor 76. Motor drive circuit 91 is a device or group of devices that serves to govern in some predetermined manner the performance of motor 76. Motor drive circuit 91 may include a manual or automatic means for starting and stopping the motor, selecting forward or reverse rotation, selecting and regulating the speed, regulating or limiting the torque, and protecting against overloads and faults. Motor drive circuit 91 controls motor 76 according to signals received from microprocessor 88.

Counterbalance Assembly:

Counterbalance assembly 40 is formed of any suitable size, shape and design and serves to provide a counterbalance force that counteracts the forces inherent when opening or closing window shade 12. In the arrangement shown, as one example, counterbalance assembly 40 extends in a generally cylindrical manner from an exterior end to an interior end. An end cap 42 is positioned at the exterior end and includes a flange 44 that has a larger diameter than the other portions of counterbalance assembly 40. Flange 44 serves to provide a stop when counterbalance assembly 40 is inserted within the hollow interior 30 of roller tube 24. As is shown, counterbalance assembly 40 is inserted in an end of roller tube 24 that is opposite motor controller assembly 38. However, in an alternative arrangement, counterbalance assembly 40 may be connected to or inserted within the same end as motor controller assembly 38 or positioned at any point within or exterior to roller tube 24.

Like motor controller assembly 38, counterbalance assembly 40 includes an end cap 42 that has an exterior collar 46 and an interior collar 48 that surround an axle 50 that is generally centrally positioned within end cap 42 and has one or more bearings 52. End cap 42 supports the end of the window shade 12 by connection of axle 50 to a bracket while allowing for rotation of roller tube 24.

Counterbalance assembly 40 includes one or more springs 114. In the arrangement shown, a single power spring (also known as a clock spring or ribbon spring) is shown contained within a housing 116. This type of spring 114 is wrapped in a circular fashion around itself and one end of the spring 114 remains stationary as the roller tube 24 rotates whereas the other end of the spring 114 rotates as the roller tube 24 rotates. In this way, spring 114 builds up a force therein or loads. This force is then released or unloaded when the roller tube 24 is rotated in an opposite direction.

While only a single housing 116 and spring 114 is shown as being used, any number of springs 114 and housings 116 are hereby contemplated for use which can be stacked in end-to-end relation to one another. In addition, while a power spring, clock spring or ribbon spring is shown being used, a torsion-type spring is also hereby contemplated for use. In this arrangement, one end of the torsion spring rotates with the roller tube 24 and the opposite end of the torsion spring remains stationary.

Power Panel:

Power panel 14 is formed of any suitable size, shape and design and serves to distribute power as well as connect hardwired control(s) 16 to motorized window shade(s) 12. In the arrangement shown, power panel 14 is formed of a box 118 and includes a plurality of sockets 120 that are connected to a power and signal distribution board 122. In one arrangement, sockets 120 are like sockets 64, 86 and are sized and shaped to receive a conventional Ethernet plug. However, any other form of socket/plug design is hereby contemplated for use.

Power panel 14 allows for a plurality of window shades 12 to be connected to power panel 14 through sockets 120. Power panel 14 also allows for one or more hardwired controls 16 to be connected to power panel 14.

In the event where the system 10 includes a greater number of hardwired controls 16 and/or motorized window shades 12 than a single power panel 14 has sockets, two or more power panels 14 can be connected together (in what is sometimes described as a "daisy chain") by connecting a cable 22 between two power panels 14. In this way, an unlimited number of motorized window shades 12 and hardwired controls 16 can be connected to one another and controlled as part of a single system.

Power panel 14 can also be connected, either wirelessly or through wired connection through connection of a router 124 or other similar internet connection device. In one arrangement router 124 is connected by a cable 22 connected to power panel 14 through connection to a socket 120. This connection enables control of system 10 through the internet through other devices such as an internet enabled computer, tablet, phone or other device.

Power panel 14 can also be connected, either wirelessly or through wired connection to a home automation system 126 or security system 128, as is further described herein. Examples of home automation system 126 include Control4, Crestron, Vera, Staples Connect, Iris, Savant, SmartThings, Wink, Nexia and the like. Examples of security systems 128 include ADT, Protect America, vivint, Frontpoint, Link Interactive, SimpliSafe, Canary, Alarmforce, and the like, to name a few. In one arrangement, home automation system 126 or security system 128 is connected by a cable 22 connected to power panel 14 through the home automation system 126 or security system 128.

In one arrangement, power panel 14 is connected to a conventional power source, such as 120 volt AC power source and through a power converter 130 converts this power to 24 volt DC power.

In the arrangement wherein Ethernet cable is used as cable 22 to connect the components of system 10, such as CAT5, CAT5e or CAT6 or similar standardized "Ethernet" cable, this type of cable is formed of eight independent wires or lines 130. Each line 130 is specified for how much information, current and voltage it is designed to carry.

In one arrangement, of the eight lines 130 in Ethernet cable two lines 130 are used to carry positive power and two lines are used to carry negative power, or stated another way two lines are connected to ground. In one arrangement the two positive power lines and the two negative power lines each carry 24 volts. By having two lines 130 carry power in and power out of the shades 12 or wired control 16, this provides greater capacity effective at the shade 12 or wired control 16. This reduces the potential that the capacity of any one line 130 could be exceeded (which could lead to damage such as wire burn-out). While each line 130 of many forms of Ethernet cable are specified to carry up to 2.0 Amps of current, due to the efficiency of the configuration of motorized window shades 12 presented herein, it has been tested and it is anticipated that the maximum current draw at maximum peak does not and will not exceed 0.5 Amps, which is well below the maximum threshold for cable 22. As such, due to the efficiency of the motorized window shades 12 presented herein (due in part to the counterbalance assembly 40), this allows for power and control of the motorized window shades 12 using Ethernet cable as cable 22.

Of the other eight lines 130, two lines 130 are utilized to carry control signals, one line 130 being a data line-in, that carries control signals into the shade 12, wired control 16, power panel 14, or the like, and one line 130 being a data line-out, that carries control signals out of the shade 12, wired control 16, power panel 14, or the like.

When two lines 130 are used to carry positive power, and two lines 130 are used to carry negative power and one line 130 is used to carry control signals in and one line 130 is used to carry control signals out, this leaves two lines 130 of the eight lines 130 as unused. These unused lines may be utilized for further functionality as the system 10 grows in sophistication and size.

In an alternative arrangement, of the eight lines 130 in Ethernet cable three lines 130 are used to carry positive power and three lines are used to carry negative power, or stated another way three lines are connected to ground. This arrangement provides added power and protection to power spikes over using just two lines for each of positive and negative power.

Using Ethernet cable as cable 22 provides many advantages over using conventional 120 volt AC power. Namely, due to the fact that the cable 22 is carrying such a low voltage and amperage, cables 22 present a much lower risk of causing a fire or other damage. As such, fewer precautions are needed when running cable 22 as compared to standard three-wire 120 volt AC wiring (such as running the wire through conduit). Because fewer precautions are needed, this can reduce the cost of running the cable 22, and in addition, in many situations a certified electrician is not needed to run cable 22, which further reduces costs. In addition, only a single cable 22 must be run to both power and control the system 10, which eliminates the complexity and cost and duplicity of running independent power and control lines. In addition, when Ethernet cable is used as cable 22, Ethernet cable is widely available, inexpensive, widely understood and easily used and installed. As such, there is no need to purchase an expensive proprietary or less-often used wire or cable and therefore using Ethernet cable as cable 22 provides many advantages.

Hardwired Control:

System 10 includes one or more hardwired controls 16. Hardwired control 16 is formed of any suitable size, shape and design and serves to control the components of system 10 through control signals carried through cables 22. In the arrangement shown, hardwired control 16 includes a faceplate 132, back plate 134 and board 136. In one arrangement, as is shown, faceplate 132 is sized and shaped to fit within a standardized large opening 138 of cover plate 140. This standardized large opening is known as a "Decora" which is a newer style of device that has been widely adopted as standard in the industry. All Decora devices fit into the same shape opening—a large rectangular opening roughly 1.25" wide by 2.5" tall. Decora devices are alternately known as decorator, designer, rocker, paddle, block, flat or wide switches. (The term "Decora" is trademarked by Leviton, a major manufacturer of electrical devices but the term is widely understood and adopted throughout the industry.) By utilizing the standardized Decora size and shape, this allows for the use of conventional and widely available parts, such as cover plate 140. As such, the exterior peripheral shape of face plate 132 fits with close tolerances within the opening 138 in conventional Decora cover plate 140.

Like faceplate 132, back plate 134 is configured to conform to existing standards such that hardwired control 16 can be used seamlessly with existing and widely available components. More specifically, back plate 134 has an exterior periphery that is similarly sized and shaped like that of face plate 132. This configuration allows hardwired control 16 to fit within conventional electrical boxes 142, also known as gang boxes. To facilitate connection to conventional electrical boxes, back plate 134 includes tabs 144 that extend upward and downward from the upper side and lower side of back plate 134. Tabs 144 include ears 146 that extend outward to the side which help facilitate alignment with electrical box 142 and also include one or more openings 148 that allow for passage of a conventional fastener, such as a screw or bolt, that facilitate connection to electrical box 142.

Board 136 is sized and shaped to be held by and between faceplate 132 and back plate 134. Board 136 includes the electrical componentry needed to operate hardwired control 16. In one arrangement, as is shown, board 136 is generally square or rectangular in shape and includes a microprocessor 150 thereon which controls the function of hardwired control 16. Board 136 also includes a plurality of sensors 152 that operatively connect to buttons 154 that extend through openings 156 in faceplate 132. When pressed, button 154 engages sensor 152 behind it which is detected by sensor 152 and a signal is transmitted to microprocessor 150. Upon receiving this signal, microprocessor 150 sends a signal according to instructions or software stored in memory.

Board 136 also includes a socket 158 which is similar to if not identical to socket 64, 120. Back plate 134 includes a recess 160 therein that provides room for socket 158 and allows for rearward access to socket 158. In the arrangement shown, socket 158 is sized and shaped to receive a conventional Ethernet plug 162 connected to cable 22.

In one arrangement, a single column of buttons 154 are presented that extend vertically across the faceplate 132. In one arrangement, the uppermost button 154 is designated as an up button, which when pressed moves the shades 12 connected to hardwired control 16 to the up or open position, and the lowermost button 154 is designated as a down button, which when pressed moves the shades 12 connected to hardwired control 16 to the down or closed position. Any number of buttons 154 are positioned between the up button and down button. These additional buttons 154 are configured to move the shades 12 connected to the hardwired control 16 to preset positions. These preset positions can be custom set by the user. Alternatively, these preset positions can be factory set as defaults. In the arrangement wherein two buttons 154 are positioned between the up button and the down button, the default setting may be to assign a default setting of approximately 33% closed and 66% closed to the buttons, respectively, as an example. In the arrangement wherein three buttons 154 are positioned between the up button and the down button, the default setting may be to assign a default setting of approximately 25% closed, 50% closed and 75% closed to the buttons, respectively, as an example. Any other number of buttons 154 and configuration of buttons are hereby contemplated for use.

In the arrangement, wherein only a single column of buttons 154 is presented in hardwired control 16, either all shades 12 connected to system 10 and assigned to respond to hardwired control 16 are controlled by the hardwired control 16. Alternatively, if the user wants to separate control of the shades 12 into groups, such that not all shades 12 respond to the single hardwired control 16, a second, third or more hardwired control 16 is added to the system 10 and the shades 12 that are to be controlled by the hardwired control 16 are programmed to only respond to a specific hardwired control 16.

In an alternative arrangement, as an example, one configuration of hardwired control 16 includes two or more columns of buttons 154. In this arrangement, where two columns of buttons 154 are presented, shades 12 connected to the system 10 can be controlled in two groups, or two banks, using only a single hardwired control 16. In an arrangement, wherein three columns of buttons 154 are presented, shades 12 connected to the system 10 can be controlled in three groups, or three banks, using only a single hardwired control 16, and so on. In these arrangements, shades 12 are programmed to respond to specific columns of buttons 154 while not responding to other columns of buttons 154.

Wireless Control:

System 10 includes one or more wireless controls 18. Wireless control 18 is formed of any suitable size, shape and design and serves to wirelessly control the components of system 10 through wireless control signals. In the arrangement shown, wireless control 18 includes a faceplate 164, back plate 166 and board 168. In one arrangement, as is shown, like hardwired control 18, faceplate 164 and back plate 166 of is sized and shaped to fit within a standardized large opening 138 of a conventional cover plate 140, such as a Dechora opening described herein. This provides the advantage that wireless control 18 can be inserted within a standard cover plate 140 which is widely available and will likely match an existing home or building's fixtures.

Wireless control 18 includes a plurality of buttons thereon. In one arrangement, as is shown, wireless control 18 includes a single column of preset position buttons 170 are presented that extend vertically across a portion of faceplate 164. In one arrangement, the uppermost button 170 is designated as an up button, which when pressed moves the shades 12 to the up or open position, and the lowermost button 170 is designated as a down button, which when pressed moves the shades 12 to the down or closed position. Any number of preset position buttons 170 are positioned between the up button and down button. These additional buttons 170 are configured to move the shades 12 to preset positions. These preset positions can be custom set by the user. Alternatively, these preset positions can be factory set as defaults. In the arrangement wherein two buttons 170 are positioned between the up button and the down button, the default setting may be to assign a default setting of approximately 33% closed and 66% closed to the buttons, respectively, as an example. In the arrangement wherein three buttons 170 are positioned between the up button and the down button, the default setting may be to assign a default setting of approximately 25% closed, 50% closed and 75% closed to the buttons, respectively, as an example. Any other number of buttons 170 and configuration of buttons are hereby contemplated for use.

Wireless control 18 also includes a toggle button 170. In the arrangement shown, toggle button 172 is rectangular in shape and vertically elongated. Toggle button 172 includes an upwardly pointing arrow positioned at an upper portion of toggle button 172, and a downwardly pointing arrow positioned at a lower portion of toggle button 172. When the upper portion of toggle button 172 is pressed, wireless control 18 transmits a signal to shades 12 to move up an incremental or small amount; when the lower portion of toggle button 172 is pressed, wireless control 18 transmits a signal to shades 12 to move down an incremental or small amount. This incremental or small amount may be in the form of moving a predetermined distance, such as one inch, two inches, three inches or the like; or moving a predetermined percentage of the travel distance between fully open and fully closed, such as one percent, two percent, three percent or the like; or moving a predetermined number of revolutions or counts or ticks sensed by sensors 104, such as one hundred counts, two hundred counts, three hundred counts or the like; or moving a predetermined percentage of revolutions or counts or ticks sensed by sensors 104, such as one percent, two percent, three percent or the like. This functionality allows a user to control the shades with finer movements than provided by merely using preset position buttons 170 and allows a user to choose positions between preset positions. These signals, that cause an incremental movement, are also known as jog signals.

In one arrangement, toggle button 172 provides dual functionality in that when pressed and released in less than a predetermined amount of time, wireless control 18 transmits a jog signal, or an incremental movement signal; whereas when pressed and held for more than a predetermined amount (which is known as a "dwell") a second signal, or dwell signal is transmitted. A dwell signal may be in the form of move all the way up or all the way down, or move up or move down a predetermined amount which greater than the incremental amount of a jog signal, or move continuously until the toggle button 172 is released. In this way, the dual functionality of toggle button 172 with the dwell functionality provides a user with a greater level of control.

Wireless control 18 also includes a channel button 174. When pressed, channel button 174 toggles between a plurality of channels as are indicated by indicators 176. In the arrangement shown, five channels are presented and represented by an indicator 176. In one arrangement, each channel provides the ability to control a unique bank or group of shades 12. In one arrangement, one of the channels, such as the first or last channel, is an all channel and controls all shades 12 associated with wireless control 18. As an example, in a room where motorized window shades 12 are placed on each of the North, East, South and West walls, when channel 1 is selected all of the motorized window shades 12 on the North wall are simultaneously and identically controlled, when channel 2 is selected all of the motorized window shades 12 on the East wall are simultaneously and identically controlled, when channel 3 is selected all of the motorized window shades 12 on the South wall are simultaneously and identically controlled, when channel 4 is selected all of the motorized window shades 12 on the West wall are simultaneously and identically controlled, and when channel 5 is selected all of the motorized window shades 12 on all walls are simultaneously and identically controlled. This arrangement provides a user with greater flexibility of control of a plurality motorized window shades 12.

Gateway:

In one arrangement, wireless control 18 communicates directly with motorized window shades 12. That is, when a button 170, 172 is pressed on wireless control 18 a wireless signal is transmitted that is directly received by the antenna 62 of each motorized window shade 12. Once received, antenna 62 transmits the signal to the radio 92 which transmits the signal to the microprocessor 88 which controls the motorized window shade 12 according to instructions stored in memory 90.

This direct control path provides some advantages. That is, the wireless control 18 communicates directly with the motorized window shade 12 and therefore no additional electronic components are necessary (such as a gateway 20 or other middle-man device) which can increase cost and complexity to a system. However, direct control also has some disadvantages. Namely, because wireless control 18 is inherently limited in power (due to being battery powered which enables it to be wireless) this essentially eliminates the ability for two-way communication between wireless control 18 and motorized window shade 12. That is, wireless control 18 is limited in functionality to merely blasting out a control signal without the ability to confirm whether the motorized window shade 12 received and properly responded to the control signal. This can cause missed control signals and inconsistency in response to wireless control 18.

One way to resolve the disadvantages of one-way communication is to employ the use of a gateway 20 such as through the use of a ZigBee-like network or protocol or other mesh network or similar protocol also commonly referred to as the internet of things.

ZigBee is a wireless mesh network protocol for low-power digital radio modules. The ZigBee protocol defines a network layer above the 802.15.4 layers to support advanced mesh routing capabilities. It allows for creating and organizing the network hierarchy providing some extra communication features such as encryption and authentication.

Through the mesh and routing capabilities, ZigBee allows the transmission of data over long distances by passing the data through intermediate nodes to more distant ones.

Features of the ZigBee protocol include:

Support for multiple network topologies such as point-to-point, point-to-multipoint and mesh networks.

Low duty cycle, which promotes long battery life.

Low latency.

Direct Sequence Spread Spectrum (DSSS).

Up to 65,000 nodes per network.

128-bit AES encryption for secure data connections.

Collision avoidance, retries and acknowledgements.

There are a plurality of different ZigBee specifications. ZigBee PRO is designed to provide the foundation for Internet of Things with features specifically needed to support low-cost, highly reliable networks for device-to-device communication. It is optimized for low power consumption and to support large networks with thousands of devices. It's an innovative, self-configuring, self-healing system of redundant, low-cost, very low-power and even battery-free nodes that enable ZigBee's unique flexibility, mobility and ease of use. ZigBee PRO now offers a new and innovative feature, Green Power that supports energy harvesting or self-powered devices that don't rely on batteries or AC mains power.

ZigBee RF4CE was designed for simple, two-way device-to-device control applications that do not require the full-featured mesh networking capabilities offered by the ZigBee specification. ZigBee RF4CE offers lower memory size requirements thereby enabling lower cost implementations. The simple device-to-device topology provides easy development and testing, resulting in faster time to market. ZigBee RF4CE provides a multi-vendor interoperable solution for consumer electronics featuring a simple, robust and low-cost communication network for two-way wireless connectivity. ZigBee RF4CE participates.

ZigBee IP is the first open standard for an IPv6-based full wireless mesh networking solution and provides seamless Internet connections to control low-power, low-cost devices. It connects dozens of the different devices into a single control network. ZigBee IP was designed to specifically support ZigBee 2030.5 an IP-based application standard for use by utilities in the home.

In the arrangement shown, utilizing a two-way communication protocol, such as ZigBee, gateway 20 serves as a middle man between wireless control 18 and motorized window shades 12. In this arrangement, gateway 20 includes an antenna 178, a radio 180, a microprocessor 182 and memory 184. These components are similar to if not identical to and cooperate and operate in a similar if not identical manner to the antenna 62, radio 92, microprocessor 88 and memory 90 described with respect to motor controller assembly 38, and those portions of the specification can be deemed repeated for gateway 20. Gateway 20 has the advantage of not running out of power as gateway 20 is configured to plug into the building or home power source. As such, gateway 20 continuously listens for wireless control signals.

In one arrangement, gateway 20 is electronically connected with the internet. As such, gateway 20 can receive control signals through the internet. This allows control and operation of motorized window shades 12 through the use of the an application or similar internet enabled software.

Battery Powered Shades:

In many applications it is not possible or convenient to run cabling 22 to the location of each motorized window shade 12. In these situations, battery powered motorized window shades 12 are desirable. Motorized window shades 12 are battery powered by installing a battery powered motor controller assembly 300.

Battery powered motor controller assembly 300 includes the elements of the hardwired motor controller assembly 38 described herein, including an antenna 62, a radio 92, a microprocessor 88 and memory 90, a motor drive circuit 91, and a motor 76. As is shown, battery powered motor controller assembly 300 also includes a battery tube 302 connected thereto that includes a plurality of batteries 304 therein. As is shown, battery tube can house 8 D-cell batteries, 6 D-cell batteries, 4 D-cell batteries, 3 D-cell batteries, 4 AA batteries, 3 AA batteries or any other amount of batteries. In the arrangement shown, the battery tube 302 is configured to be positioned within the hollow interior 30 or the roller tube 24.

In another arrangement, the battery tube 302 is a separate component from the motor controller assembly 38 and is connected to the motor controller assembly 38 by a cable 22. This is known as a satellite battery arrangement. In yet another configuration a solar cell 306 or other power source is connected to motor controller assembly 38 by cable 22 and either replaces battery tube 302 or works in concert with battery tube 302.

When motorized window shades 12 are powered by batteries 304, power consumption must be minimized to extend the life of the batteries 304 and maximize the interval between required replacement of the batteries 304. This is accomplished by various techniques such as sleep mode and polling as is described herein.

Range Extender:

In one arrangement, as is shown, system 10 includes a range extender 308. Range extender 308 is simply a repeater that extends the range of the mesh network or strengthens the mesh network. Range extender 308, like gateway 20 includes an antenna 178, a radio 180, a microprocessor 182 and memory 184. These components are similar to if not identical to and cooperate and operate in a similar if not identical manner to the antenna 62, radio 92, microprocessor 88 and memory 90 described with respect to motor controller assembly 38, and those portions of the specification can be deemed repeated for gateway 20. Like gateway 20, range extender 308 has the advantage of not running out of power as gateway 20 is configured to plug into the building or home power source. As such, like gateway 20, range extender 308 continuously listens for wireless control signals.

In one arrangement, gateway 20 is electronically connected with the internet. As such, gateway 20 can receive control signals through the internet. This allows control and operation of motorized window shades 12 through the use of an application or similar internet enabled software system or device.

Wireless Control, Network Coordinator, Repeater, End Device, Sleeping End Device, Parent Devices:

In the mesh network established by the system 10 there are the following components that cooperate with one another to ensure that the desired operation is performed. These components are, hardwired controls 16, wireless controls 18, a network coordinator, repeaters, end devices, and sleeping end devices.

A network coordinator establishes the network. A repeater is any device on the network that receives a signal and repeats it to other devices on the network. An end device is a device on the network receives signals but does not repeat them. To conserve energy, and therefore battery life, a sleeping end device is a device that toggles between an awake state and an asleep state. In an awake state, the sleeping end device polls its parent device to ask if it has a control signal for the sleeping end device. The parent device can be any device on the network that can serve as a repeater.

Interaction Between Hardwired Remote and Hardwired Motorized Window Shades:

When a button is pressed on hardwired control 16, the control signal is transmitted through power panel 14 and out to the hardwired motorized window shades 12 that are connected by cables 22 to the power pane 14 and therefor to the hardwired control 16. In response to receiving this control signal, the hardwired motorized window shades 12 respond accordingly. As the cabling 22 is directly connected to hardwired motorized window shades 12, there is no potential for loss of signal like there is with wireless control signals. In addition, because the cabling 22 also carries power to the hardwired motorized window shades 12 as well as the control signals, there is no potential for a lack of sensitivity or a power-outage due to diminished battery capacity. As such, control signals from the hardwired control 16 are all but assured of reaching their target and being responded to accordingly.

Interaction Between Hardwired Remote and Battery Powered Motorized Window Shades:

In one arrangement, when system 10 includes motorized window shades 12 that are controlled by a battery powered motor controller assembly 300, the hardwired control 16 does not have a direct communication path to the battery powered motorized window shades 12. To solve this problem, a device is connected by cable 22 to power panel 14 that wirelessly transmits control signal to the battery powered motorized window shades 12. This device can be any device such as gateway 20, range extender 308, or any device that serves as a repeater.

In one arrangement, as is described herein, motorized window shades 12 act as repeaters themselves. In this arrangement, when a control signal is transmitted from the hardwired control 16 through power panel 14 and out to the hardwired motorized window shades 12. One or more hardwired motorized window shades 12 act as repeaters, and broadcast this control signal out over the wireless network.

Interaction between Wireless Remote and Hardwired Motorized Window Shades:

While using a hardwired control 16 has many advantages having a wireless control 18 provides the flexibility and freedom that the wireless control 18 can be located anywhere. However dealing with wireless control signals provides its own unique set of challenges.

When a button 170, 172 is pressed on wireless control 18, a corresponding wireless control signal is transmitted. This wireless control signal is received by any or all of the following, gateway 20, range extender 308, and or hardwired motorized window shades 12.

Direct Communication:

In one arrangement, the wireless control 18 communicates directly with one or more hardwired window shades 12. In this arrangement, because hardwired motorized window shades 12 are connected to a continuous power source through cable 22 and energy consumption is not a concern (in the way it is with battery powered motorized window shades 12) the hardwired motorized window shades 12 are continuously listening for control signals. When the wireless control signal is broadcast it is received by antenna 62 of hardwired motorized window shade 12 and transmitted to and processed by radio 92 and transmitted to microprocessor 88 which further processes the signal according to instructions stored in memory 90. Upon reception and recognition of the wireless control signal, the hardwired motorized window shade 12 responds accordingly, such as moving to an open or closed position.

When motorized window shade 12 is configured to act as a repeater (and not an end device) motorized window shade 12 rebroadcasts this control signal to the other nodes on the network through radio 92 and antenna 62, and the process is repeated.

Communication Through Intermediary:

In one arrangement, the wireless control 18 communicates with hardwired motorized window shades 12 through an intermediary device such as gateway 20 and/or range extender 308. In this arrangement, because gateway 20 and/or range extender 308 are connected to a continuous power source through cable 22 and energy consumption is not a concern (in the way it is with battery powered motorized window shades 12) the gateway 20 and/or range extender 308 are continuously listening for control signals. When the wireless control signal is broadcast it is received by gateway 20 and/or range extender 308 by antenna 178 and transmitted to and processed by radio 180 and transmitted to microprocessor 182 which further processes the signal according to instructions stored in memory 184. Upon reception and recognition of the wireless control signal, the gateway 20 and/or range extender 308 then responds ether by repeating the control signal and/or storing the control signal to be provided upon request when the gateway 20 and/or range extender 308 is polled by a motorized window shade 12, as is further described herein.

In the arrangement, wherein gateway 20 and/or range extender 308 is configured to act as a repeater, when the wireless control signal is received, the gateway 20 and/or range extender 308 instantly or after a short delay rebroadcasts the wireless control signal to the other nodes in the network.

In an alternative arrangement, gateway 20 and/or range extender 308 communicate with hardwired motorized window shades 12 through polling, as is further described herein.

Interaction Between Wireless Remote and Battery Powered Wired Motorized Window Shades:

Power consumption is not a concern for hardwired motorized window shades 12 because they are connected to an endless supply of power. As such, hardwired motorized window shades 12 are configured to listen continuously for wireless control signals.

In contrast, battery powered motorized window shades 12 are configured to maximize battery life by minimizing power consumption. In one arrangement, this is accomplished by switching between an awake state and an asleep state. One drawback to this arrangement is that because the battery powered motorized window shade 12 is not continuously awake, or not continuously listening for wireless control signals, it cannot be anticipated that when a wireless control signal is transmitted that the battery powered motorized window shade 12 will directly receive the wireless control signal. To overcome this deficiency, battery powered motorized window shades 12 employ a technique called polling to receive control signals transmitted by wireless control 18.

That is, gateway 20, (or another repeater connected to a continuous power source) continuously listens for wireless control signals and acknowledges reception of these signals to wireless control 18 (as is further described herein) and stores these control signals until polled by battery powered motorized window shade 12.

More specifically, in one arrangement, when a button 170, 172 is pressed on wireless control 18, a corresponding wireless control signal is transmitted. This wireless control signal is received by antenna 178 of gateway 20 (or other repeater), which is continuously listening, processed by radio 180 and transmitted to microprocessor 182 which further processes the signal according to instructions stored in memory 184. Upon reception and recognition of the wireless control signal, gateway 20 stores the control signal until asked to provide instructions by motorized window shade(s) 12.

In this arrangement, battery powered motorized window shade(s) 12 check in with gateway 20 at periodic intervals. This process is known as poling. That is, at predetermined periodic intervals motorized window shade(s) 12 wake up and transmit a signal to gateway 20 requesting gateway 20 if it has received any instructions for the motorized window shade 12. If gateway 20 has not received a wireless control signal for the motorized window shade 12 the gateway 20 responds with an affirmative "no" signal and the motorized window shade 12 does not perform a function and goes back to sleep for a predetermined amount of time before repeating this polling step after a predetermined amount of time.

If, on the other hand, gateway 20 has received a wireless control signal for the motorized window shade 12 the gateway 20 responds either with a "yes" or with the wireless control signal intended for the motorized window shade 12.

In the arrangement, wherein gateway 20 responds with a "yes", upon receiving this wireless signal from gateway 20 which is an affirmative confirmation that gateway 20 has received a wireless control signal for motorized window shade 12, motorized window shade 12 responds with a request that gateway 20 transmit the wireless control signal to motorized window shade 12. Upon receiving this wireless signal from motorized window shade 12 which is an affirmative confirmation that motorized window shade 12 is ready for the wireless control signal, gateway 20 responds by providing the wireless control signal, which is the instruction to move in the manner commanded by the user of wireless control 18.

Upon receiving this wireless control signal from gateway 20, which is the instruction to move in the manner commanded by the user of the wireless control 18, the motorized window shade 12 responds to the gateway 20 with a confirmation that it received the wireless control signal and that either it understands the wireless control signal and it is moving in the desired manner, or it responds with an error message. In the event an error message is transmitted by the motorized window shade 12, the gateway 20 re-transmits the wireless control signal back to the motorized window shade 12 and the process is repeated.

In one arrangement, motorized window shade 12 transmits a confirmation to gateway 20 that it received the wireless control signal and that it is moving in the desired manner, the motorized window shade 12 continues to transmit progress data to gateway 20 until the motion is complete at which point motorized window shade 12 transmits a signal informing gateway that the command has been executed, provides the current position of the motorized window shade 12 to the gateway 20 and asks the gateway 20 if it has any further instructions.

In the event that the gateway 20 has not received any further wireless control signals, the gateway 20 responds with an affirmative "no" and the motorized window shade 12 goes back to sleep or waits for a predetermined amount of time and the process is repeated as is described. In the event that the gateway 20 has received further wireless control signals, the gateway 20 responds with a "yes" and the process is repeated as is described.

In an alternative arrangement, when polled gateway 20 responds to the poll from motorized window shade 12 with the wireless control signal, which eliminates one set of back and forth commands, thereby streamlining the process.

It is through this process of "handshaking" where gateway 20 and motorized window shade 12 communicate with one another and confirm each communication has been properly received and acted upon that the system 10 provides greater reliability and robustness and ensures that wireless control signals are not missed and that the commands are properly executed.

Gateway 20 has the advantage of not running out of power as gateway 20 is configured to plug into the building or home power source. As such, unlike wireless control 18, the functionality of gateway 20 is not strictly limited by its power source, which enables it to be continuously on and allows it to be continuously pinged or asked for instructions by motorized window shades (12).

Iterative Rebroadcasting:

In one arrangement, the wireless control signal is rebroadcast several times, such as two, three, four, five, six, seven, eight, nine, ten times or more over a predetermined amount of time. This iterative rebroadcasting provides greater confidence that the wireless control signal will be received by its intended target. This iterative rebroadcasting also helps to overcome any temporary wireless interference that may prevent a signal from reaching its intended target.

Parent & Wireless Control Signal Acknowledgement:

Wireless control 18 is typically powered by a small battery, such as a coin cell battery, one or more AAA or AA cell batteries, or the like. As such, wireless control 18 is severely limited in power consumption. Despite power limitations, in one arrangement wireless control 18 performs a handshake with its parent device to ensure that when wireless control 18 transmits a wireless control signal that it has been received.

That is, to provide a higher level of confidence that a wireless control signal has been received, wireless control 18 is paired with a parent device, such as gateway 20, range extender 308 or a repeater on the network (such as a hardwired motorized window shade 12) or the like. When a wireless control signal is broadcast by wireless control 18, wireless control 18 waits to receive an acknowledgement by its paired parent device. This acknowledgement is in itself a wireless signal that is received by the antenna, radio and microprocessor of wireless control 18. In the event that wireless control 18 does not receive the expected acknowledgement from its parent, wireless control 18 is configured to interpret this as a failure of the wireless control signal to reach its intended recipient. In response to this failure, wireless control 18 seeks out a new path and a new parent device through the network established by system 10. Once wireless control 18 establishes a new parent, that parent provides an acknowledgement signal.

While polling is described herein for use with battery powered motorized window shades 12, polling can be equally used with hardwired motorized window shades 12, however the energy efficiency benefits are not as important.

Rapid Polling:

As is described above, polling is employed to help extend battery life and minimize power consumption. The longer the asleep period exists between polls the greater the battery life. However, the longer the asleep period of time between polls, the greater the delay there is between a button press on wireless control 18 and execution of an instruction by motorized window shades 12.

In one arrangement, battery life is balanced with acceptable responsiveness of the motorized window shades 12 by selecting the proper amount of time that the motorized window shades 12 sleep. That is, iterative sleep periods and awake periods may be separated by thousandths of a second, hundredths of a second, tenths of a second, by a whole second or by multiple seconds. The longer the asleep period the longer the battery life; however the longer the asleep period of time the longer the delay in responding to a wireless control signal. In some applications, an asleep period of time of a tenth of a second may be unacceptable, whereas in other applications an asleep period of time of an entire second or multiple seconds may be acceptable.

As an example, the effects of the delay caused by the asleep period of time is particularly apparent when a plurality of motorized window shades 12 are installed next to one another and are controlled by the same wireless control 18. It is known that consumers desire their motorized window shades 12 to open and close in unison with one another. However, the longer the asleep period, the greater the variability there is between when each particular motorized window shade 12 receives the wireless control signal. As such, the longer the asleep state, the greater the potential for staggering between the motorized window shades 12, which is undesirable.

More specifically, these motorized window shades 12 iterate between an asleep state and an awake state where they poll or check-in with their parent gateway 20 to see if any wireless control signals have been received by the gateway 20. When a control signal is transmitted by wireless control 18 to gateway 20, some motorized window shades 12 may receive the control signal quickly if they poll the gateway 20 shortly after the gateway 20 receives the control signal, whereas other motorized window shades 12 (that just completed a poll of the gateway 20 prior to the gateway 20 receiving the control signal) will wait almost the entire asleep period of time before receiving the control signal. As such, when the motorized window shades 12 receive the control signal is based on essentially the randomness of when the motorized window shades 12 poll gateway 20. The longer the asleep state the greater the potential variability between when the motorized window shades 12 receive the wireless control signal and when they initiate movement.

To resolve this problem a rapid polling mode is employed. That is, motorized window shades 12 spend the vast majority of their life in a stationary position. Said another way, it is only a very small segment of their life where they receive control signals to move. As such, the vast majority of the time that motorized window shades 12 poll gateway 20, gateway 20 responds stating that it does not have a wireless control signal for that particular motorized window shade 12. However, there are some indicators that can be used to indicate whether a wireless control signal may be coming. In response to these indicators, a wireless control signal 12 is transmitted to gateway 20 to put the motorized window shades 12 into a rapid polling mode.

A rapid polling mode 12 means that the motorized window shades 12 are placed in a state where they poll gateway 20 at a more-frequent rate than when the motorized window shades 12 are not in a rapid polling mode.

As one example, in a normal state (a non-rapid polling mode) motorized window shades 12 are configured to poll gateway 20 every ½ of a second whereas when in a rapid polling mode, motorized window shades 12 are configured to poll gateway 20 every one hundredth of a second. As another example, in a normal state (a non-rapid polling mode) motorized window shades 12 are configured to poll gateway 20 every second whereas when in a rapid polling mode, motorized window shades 12 are configured to poll gateway 20 every one tenth of a second. As another example, in a normal state (a non-rapid polling mode) motorized window shades 12 are configured to poll gateway 20 every third of a second whereas when in a rapid polling mode, motorized window shades 12 are configured to continuously poll or continuously listen for a control signal from gateway 20.

The rapid polling mode continues for a predetermined period of time after an indicator is detected, such as one second, two seconds, three seconds, four seconds, five seconds, six seconds, seven seconds, eight seconds, nine seconds, ten seconds or more or any other period of time.

By reducing the asleep period between awake periods in the rapid polling mode, or by reducing the amount of time between polls, this reduces the potential variability between when motorized window shades 12 receive a wireless control signal. This in-turn reduces or eliminates the stagger between when motorized window shades 12 initiate movement. In addition, by utilizing a rapid polling mode, this allows for the asleep period to be longer than when no rapid polling mode is used. This is because it is likely that the motorized window shades 12 will be in a rapid polling mode when a control signal is transmitted for the motorized window shades 12. In addition, because the rapid polling mode is only put into effect when an indicator is detected, which only occurs during a very small amount of the life of a motorized window shade 12, the battery life is not substantially diminished because the rapid polling mode only occurs relatively infrequently. In addition, any reduction in battery life caused by the rapid polling mode may be gained by extending the asleep period of time between polls. As such, utilization of the rapid polling mode may provide substantial battery life improvements.

Indicators:

There are various indicators that can be used to enter a rapid polling mode. Again, the vast majority of the time motorized window shades 12 are inactive. As such, any indication of activity can be used as an indicator to prompt entry into a rapid polling mode.

One indicator that can be used to put the motorized window shades 12 into a rapid polling mode is when a control signal is transmitted from a hardwired control 16. This can be any control signal. The transmission of this control signal can be used to indicate activity on the network and place the motorized window shades into a rapid polling mode. When this occurs, a signal is transmitted to gateway 20 such that the next time the battery powered motorized window shades 12 poll gateway 20, gateway 20 responds with a wireless control signal to place the battery powered motorized window shades 20 (and/or other battery powered components on the system 10) to enter into a rapid polling mode.

Another indicator that can be used to put the motorized window shades 12 into a rapid polling mode is when a wireless control signal is transmitted from a wireless control 18. This can be any control signal. The transmission of this control signal can be used to indicate activity on the network and place the motorized window shades into a rapid polling mode.

In one arrangement, a computing device 310 such as a laptop, cell phone, tablet, iPad or the like is used in association with the system 10 to control operation of the system 10, or more specifically to control operation of the motorized window shades 12. Computing device 310 has an application 312 installed on it that interfaces with the network of system 10 and is used to control motorized window shades 12. Application 312 is any form of software, code or a program that facilitates communication with the network of system 10, wirelessly and/or through the internet, and allows for control of motorized window shades 12. In this way, computing device 310 is not unlike wireless control 18 in this manner. One indicator that can be used to place motorized window shades 12 into a rapid polling mode is when the application 312 is opened, as this is an indicator that wireless control signals are likely to follow. Alternatively, one indicator that can be used to place motorized window shades 12 into a rapid polling mode is when any activity occurs on application 312, as this is an indicator that wireless control signals are likely to follow.

In one arrangement, wireless control 18 includes a motion sensor, such as an accelerometer, a mercury switch, a vibration sensor, or the like. This motion sensor transmits a signal to the microprocessor of the wireless control 18. When this motion sensor senses motion, such as a user picking up a wireless control 18, the signaled motion from motion sensor can be used as an indicator to place motorized window shades 12 into a rapid polling mode as it is likely that a wireless control signal will be transmitted shortly after the wireless control 18 experiences motion. As such, in response to sensed motion, the wireless control 18 transmits a rapid polling mode signal to gateway 20 and the gateway 20 transmits a rapid polling mode signal to the battery powered motorized window shades 12 that poll gateway 20.

Another indicator that can be used to put the motorized window shades 12 into a rapid polling mode is when a motorized window shade 12 is tugged. This indicates that a user is adjusting the position of the motorized window shades 12. The tug on any motorized window shade 12 on the network can be used to indicate activity on the network and place the motorized window shades into a rapid polling mode. In response to sensing a tug, a motorized window shade 12 transmits a wireless signal that it has been tugged. Gateway 20 interprets this as activity on the network and therefore as an indicator. Gateway 20 then transmits a rapid polling mode signal to the battery powered motorized window shades 12 that poll gateway 20.

Any other form of activity on any device on the network of system 10 can be used as an indicator.

In response to sensing that an indicator has been detected, a signal is transmitted, likely through gateway 20 or any repeater (such as range extender 308 or a motorized window shade 12 that is operating as a repeater) that the motorized window shades 12 that poll for wireless control signals should enter a rapid polling mode. That is, in the arrangement where a battery powered motorized window shade 12 polls gateway 20 for wireless control signals, when an indicator is detected, gateway 20 stores an instruction to enter into a rapid polling mode. Then, the next time the motorized window shades 12 poll gateway 20, gateway 20 transmits a control signal instructing each polling motorized window shade 12 to enter into a rapid polling mode.

Once the motorized window shades 12 receive this rapid polling mode wireless control signal, motorized window shade 12 enters a rapid polling mode where the delay between polls is shorter than during normal operation. This rapid polling mode continues for a predetermined amount of time until the rapid polling mode expires.

In operation, using a rapid polling mode, a plurality of battery powered motorized window shades 12 are presented. These battery powered motorized window shades 12 switch between an asleep state, where energy is conserved, and an awake state where the battery powered motorized window shades 12 poll gateway 20, or another parent device, wherein the asleep state lasts for a predetermined amount of time. Wherein the system 10 detects when an indicator occurs, such as a tug on a motorized window shade 12, the transmission of a hardwired control signal, the transmission of a wireless control signal, the opening of an application, the movement of a wireless control, or any other activity. In response to detection of an indicator, the gateway transmits a rapid polling mode signal to the battery powered motorized window shades 12. In response to receiving this rapid polling mode signal the battery powered motorized window shades 12 enter a rapid polling mode for a predetermined amount of time. In the rapid polling mode, the battery powered motorized window shades 12 poll the gateway at a more-frequent rate. That is, the period of time between polls in the rapid polling mode is less than in standard operation.

Speed Varying Device:

The opening and closing speed of motorized window shades 12 varies for countless reasons. Different models of motors 76 and different designs of motors 76 tend to operate differently and at different speeds. In addition, motors 76 from different manufacturers tend to run at different speeds. Even when the same manufacturer and model are compared, some motors 76 are more efficient or have a natural tendency to run faster or "hotter" than others, while other motors 76 are less efficient or have a natural tendency to run slower or "colder" than others. In addition, variations in the gear ratio of gear box assembly 78 also drastically affect the speed of motorized window shades 12. In addition, differences in the length of roller tube 22 or height of shade material 34 affect the speed of motorized window shades 12. Even variations between pieces of fabric of shade material 34 also affect the speed of motorized window shades 12. Another variable that substantially affects the opening and closing speed is whether the motorized window shades 12 are powered by an unlimited power source, such as hardwired power, or powered by a limited power source such as batteries, a solar power panel. These are just a few of the countless factors and variables that affect the speed of motorized window shades 12.

All of these variables cause different motorized window shades 12 to run at different speeds. However, consumers tend to desire that their motorized window shades 12 open and close in unison and at approximately the same speed.

Complicating matters further, in many applications where a plurality of motorized window shades 12 are installed in the same room or within sight of one another include motorized window shades 12 of varying widths and/or heights. These varying dimensions often dictate different configurations (such as heavier-duty motors 76 or higher gear ratios for wider or taller shades and lighter-duty motors 76 or lower gear ratios for narrower or shorter shades). In addition, in many applications, a mix of motorized window shades 12 are installed, some powered by an unlimited power source, such as hardwired power, while others are powered by a limited power source such as one or more batteries. These different configurations cause the different motorized window shades 12 to operate at different opening or closing speeds.

To alleviate this problem, as one example, a speed varying device 200 is presented that is connected to each motorized window shade 12, whether the motorized window shade 12 is powered by an unlimited power source, such as being hardwired to a power source, or powered by one or more batteries. Speed varying device 200 is any form of a device that is adjustable and adjusts the opening and closing speed of motorized window shade 12.

In one arrangement, as is presented as one of many examples, speed varying device 200 is a potentiometer or a digital potentiometer.

Background on Potentiometers: A potentiometer informally known as a pot, is a three-terminal resistor with a sliding or rotating contact that forms an adjustable voltage divider. If only two terminals are used, one end and the wiper, it acts as a variable resistor or rheostat.

Potentiometers consist of a resistive element, a sliding contact (wiper) that moves along the element, making electrical contact with one part of it, electrical terminals at each end of the element, a mechanism that moves the wiper from one end to the other, and a housing containing the element and wiper.

Many simple or inexpensive potentiometers are constructed with a resistive element formed into an arc of a circle usually a little less than a full turn and a wiper sliding on this element when rotated, making electrical contact. The resistive element, with a terminal at each end, is flat or angled. The wiper is connected to a third terminal, usually between the other two. On panel potentiometers, the wiper is usually the center terminal of three. For single-turn potentiometers, this wiper typically travels just under one revolution around the contact.

Another type is the linear slider potentiometer, which has a wiper which slides along a linear element instead of rotating. An advantage of the slider potentiometer is that the slider position gives a visual indication of its setting. While the setting of a rotary potentiometer can be seen by the position of a marking on the knob, an array of sliders can give a visual impression of, for example, the effect of a multi-band equalizer (hence the term "graphic equalizer").

The resistive element of inexpensive potentiometers is often made of graphite. Other materials used include resistance wire, carbon particles in plastic, and a ceramic/metal mixture called cermet. Conductive track potentiometers use conductive polymer resistor pastes that contain hard-wearing resins and polymers, solvents, and lubricant, in addition to the carbon that provides the conductive properties.

Others are enclosed within the equipment and are intended to be adjusted to calibrate equipment during manufacture or repair, and not otherwise touched. They are usually physically much smaller than user-accessible potentiometers, and may need to be operated by a screwdriver rather than having a knob. They are usually called "preset potentiometers" or "trim[ming] pots". Some presets are accessible by a small screwdriver poked through a hole in the case to allow servicing without dismantling.

Multiturn potentiometers are also operated by rotating a shaft, but by several turns rather than less than a full turn. Some multiturn potentiometers have a linear resistive element with a sliding contact moved by a lead screw; others have a helical resistive element and a wiper that turns through 10, 20, or more complete revolutions, moving along the helix as it rotates. Multiturn potentiometers, both user-accessible and preset, allow finer adjustments; rotation through the same angle changes the setting by typically a tenth as much as for a simple rotary potentiometer.

A string potentiometer is a multi-turn potentiometer operated by an attached reel of wire turning against a spring, enabling it to convert linear position to a variable resistance.

User-accessible rotary potentiometers can be fitted with a switch which operates usually at the anti-clockwise extreme of rotation. Before digital electronics became the norm such a component was used to allow radio and television receivers and other equipment to be switched on at minimum volume with an audible click, then the volume increased, by turning a knob. Multiple resistance elements can be ganged together with their sliding contacts on the same shaft, for example, in stereo audio amplifiers for volume control. In other applications, such as domestic light dimmers, the normal usage pattern is best satisfied if the potentiometer remains set at its current position, so the switch is operated by a push action, alternately on and off, by axial presses of the knob.

The relationship between slider position and resistance, known as the "taper" or "law", is controlled by the manufacturer. In principle any relationship is possible, but for most purposes linear or logarithmic (aka "audio taper") potentiometers are sufficient.

Linear Taper Potentiometer:

A linear taper potentiometer (linear describes the electrical characteristic of the device, not the geometry of the resistive element) has a resistive element of constant cross-section, resulting in a device where the resistance between the contact (wiper) and one end terminal is proportional to the distance between them. Linear taper potentiometers are used when the division ratio of the potentiometer must be proportional to the angle of shaft rotation (or slider position), for example, controls used for adjusting the centering of the display on an analog cathode-ray oscilloscope. Precision potentiometers have an accurate relationship between resistance and slider position.

Logarithmic Potentiometer:

A logarithmic taper potentiometer has a resistive element that either 'tapers' in from one end to the other, or is made from a material whose resistivity varies from one end to the other. This results in a device where output voltage is a logarithmic function of the slider position.

Digital Potentiometer:

A digital potentiometer (often called "digipot") is an electronic component that mimics the functions of analog potentiometers. Through digital input signals, the resistance between two terminals is adjusted, just as in an analog potentiometer.

There are two main functional types: volatile, which lose their set position if power is removed, and are usually designed to initialize at the minimum position, and non-volatile, which retain their set position using a storage mechanism similar to Flash memory or EEPROM.

Usage of a digipot is far more complex than that of a simple mechanical potentiometer, and there are many limitations to observe. A digipot is generally immune to the effects of moderate long-term mechanical vibration or environmental contamination, to the same extent as other semiconductor devices, and can be secured electronically against unauthorized tampering by protecting the access to its programming inputs by various means.

In equipment which has a microprocessor, FPGA or other functional logic which can store settings and reload them to the "potentiometer" every time the equipment is powered up, a multiplying DAC can be used in place of a digipot, and this can offer higher setting resolution, less drift with temperature, and more operational flexibility.

A digital potentiometer is built either from a resistor ladder integrated circuit or a digital-to-analog converter. Every step on the resistor ladder has its own switch which can connect this step to the output terminal of the potentiometer. The selected step on the ladder determines the resistance ratio of the digital potentiometer. The number of steps is normally indicated with a bit value e.g. 8 bits equals 256 steps; with resolutions between 5 and 10 bits (32 to 1024 steps) are available. Digital potentiometers tend to use digital protocols like PC or Serial Peripheral Interface Bus for signaling while some use simpler up/down protocols.

Figure 13:
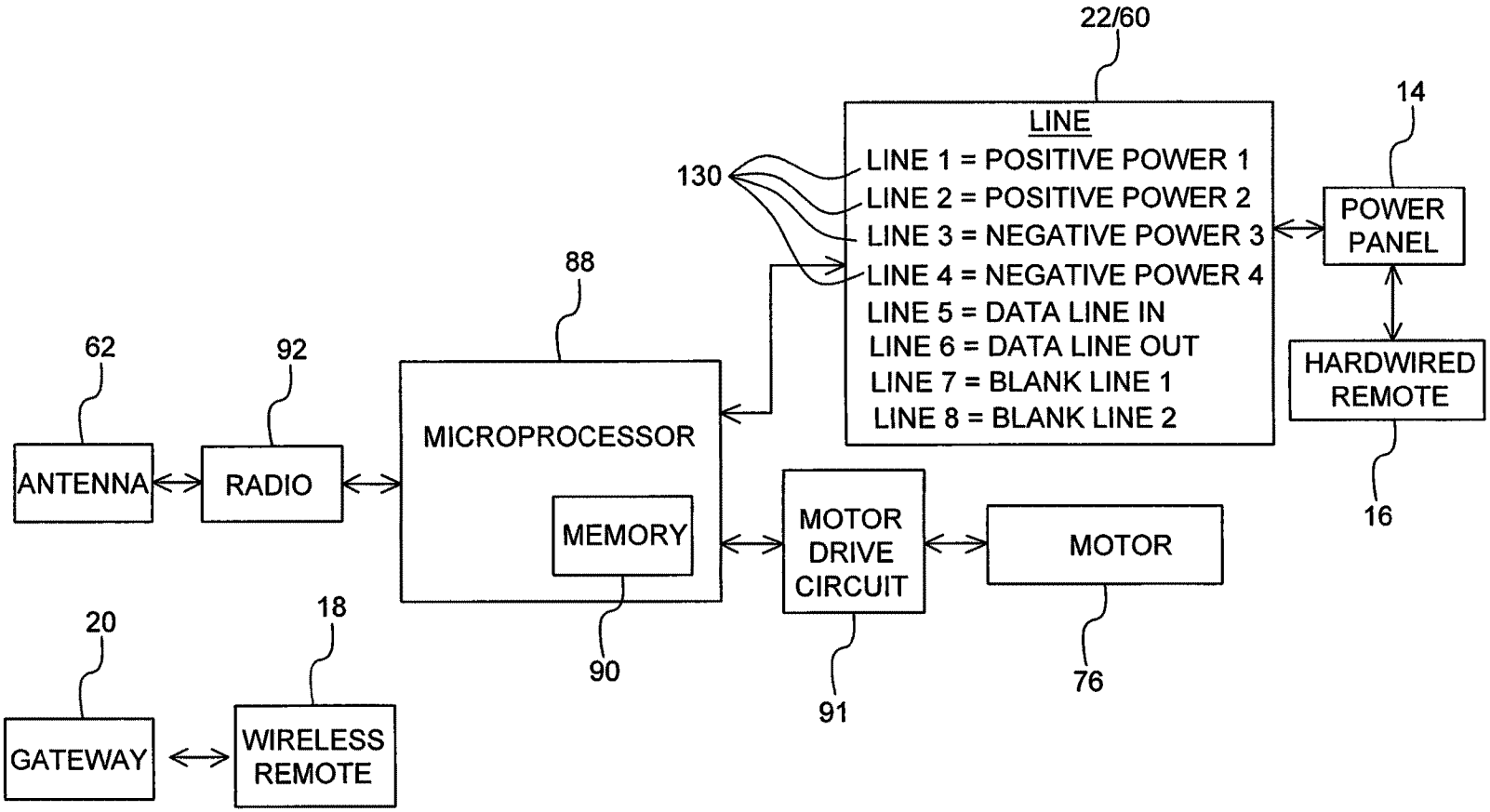
FIG. 13 is a plan schematic view of the improved motorized window shade system of FIG. 1.
Figure 14:
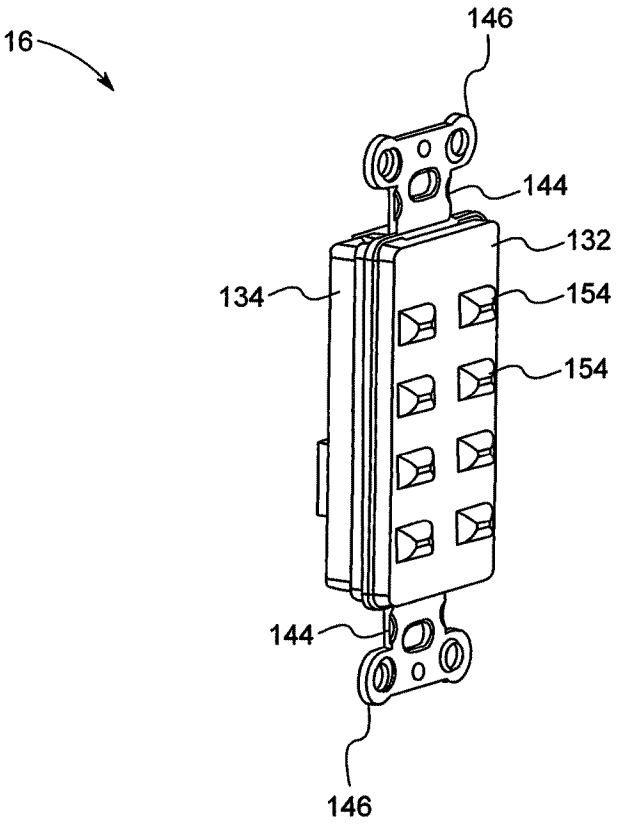
FIG. 14 is a perspective view of a hardwired control having two columns of buttons that independently control two banks of motorized window shades.
Figure 15:
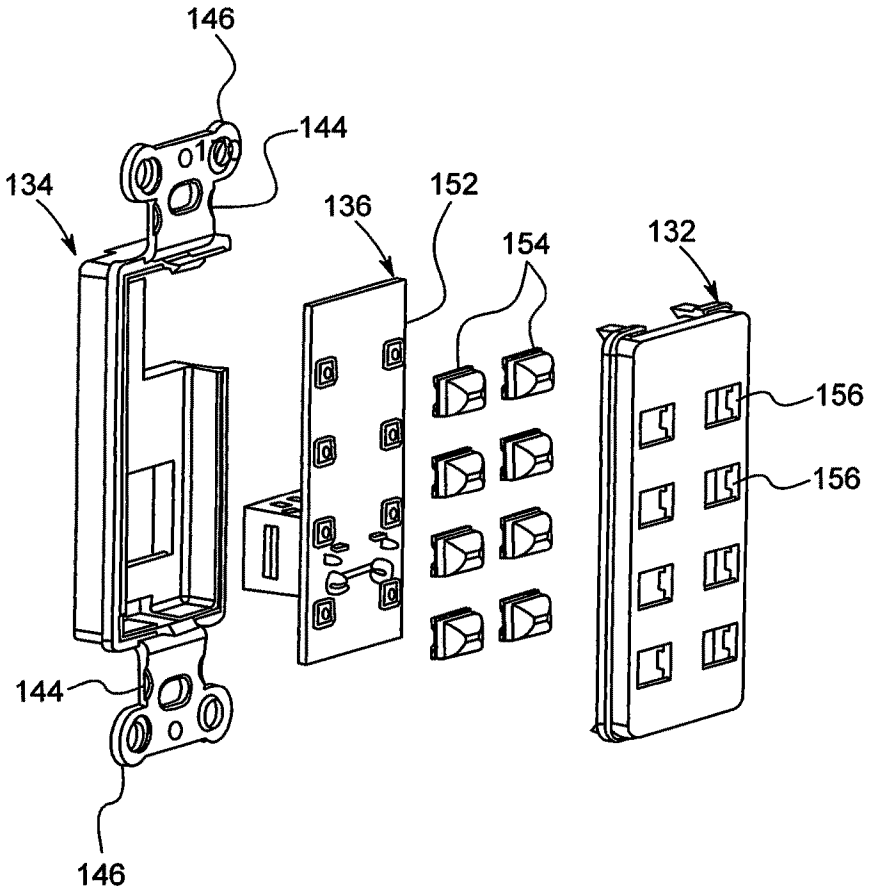
FIG. 15 is an exploded perspective view of the hardwired control of FIG. 14.
Figure 16:
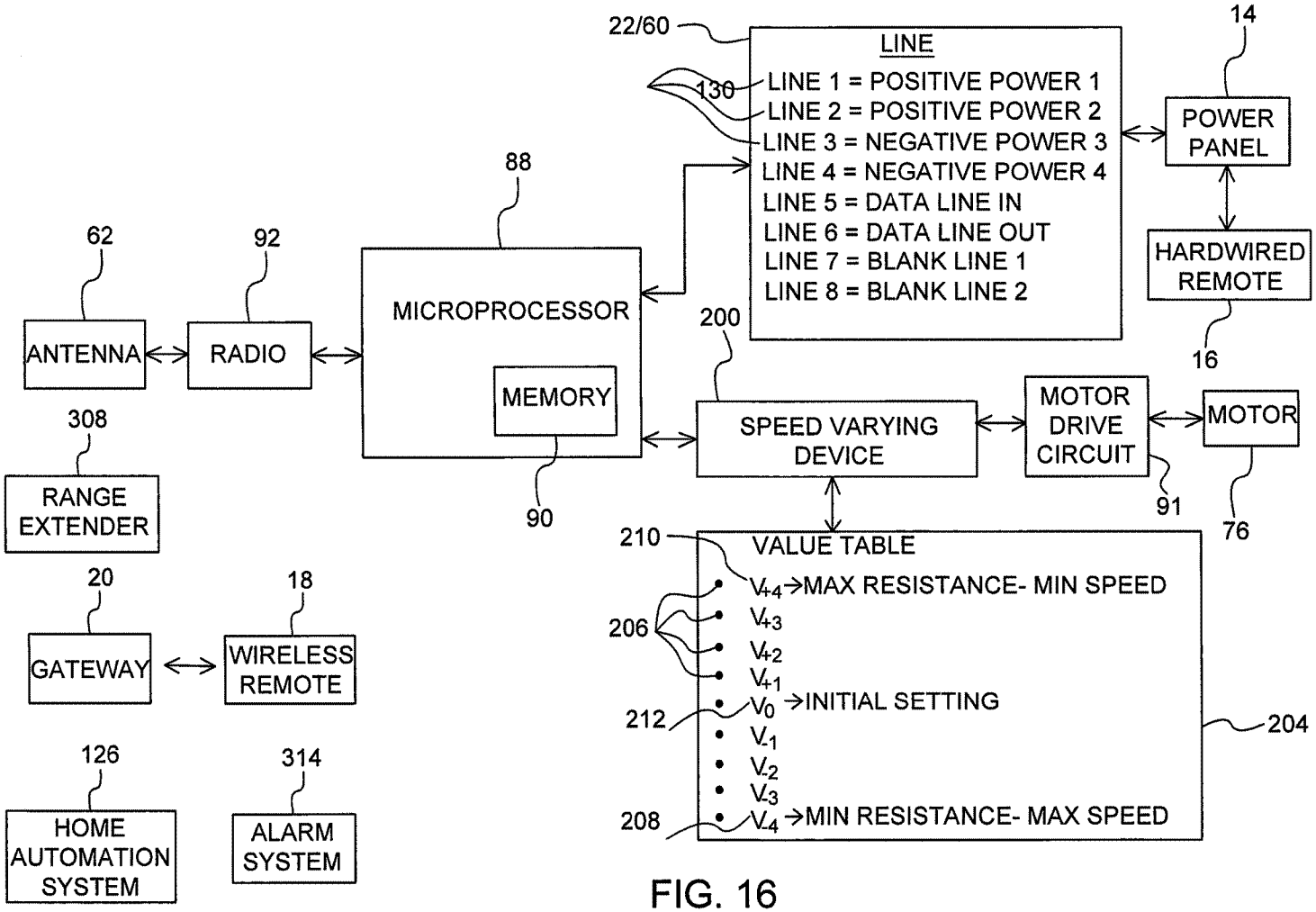
FIG. 16 is a plan schematic view of an alternative embodiment of a motorized window shade system having a speed varying device.
Figure 17A:
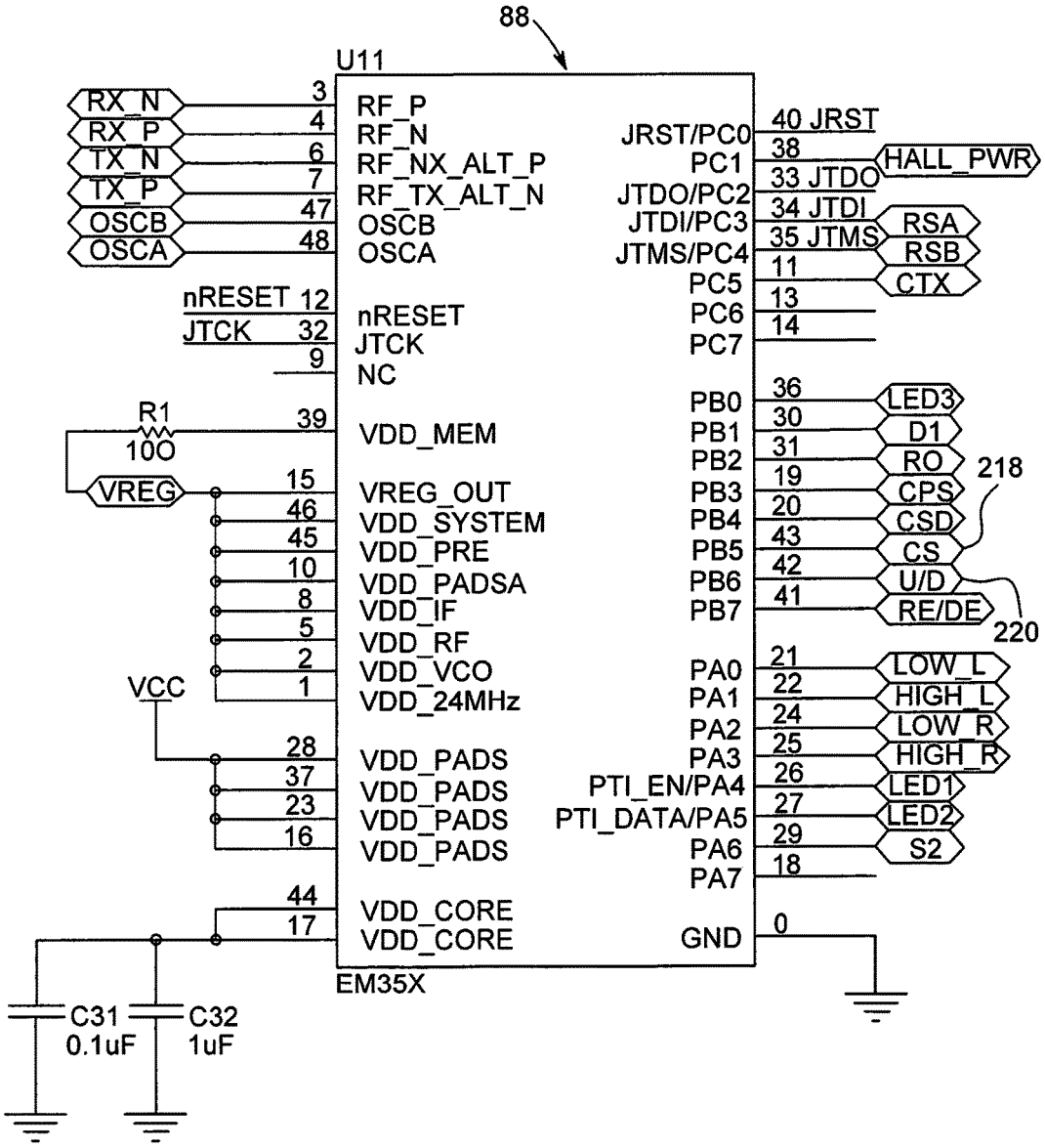
FIG. 17A is a plan schematic view of a portion of a circuit diagram of a motorized window shade having a speed varying device.
Figure 17D:
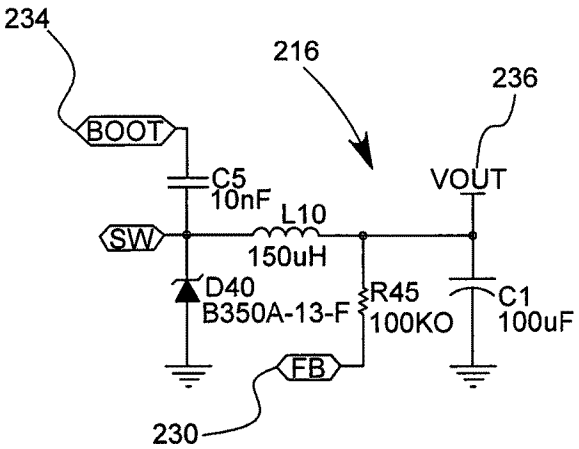
FIG. 17D is a plan schematic view of a portion of a circuit diagram of a motorized window shade having a speed varying device.
Figure 17B:
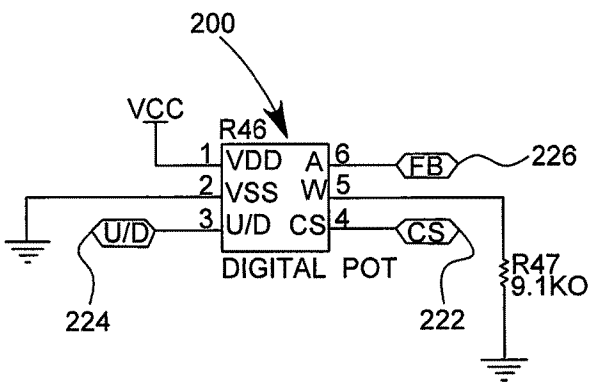
FIG. 17B is a plan schematic view of a portion of a circuit diagram of a motorized window shade having a speed varying device.
Figure 17C:
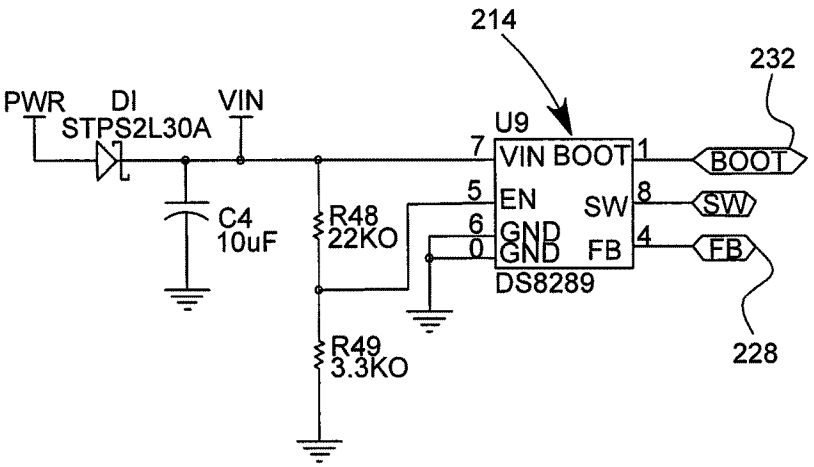
FIG. 17C is a plan schematic view of a portion of a circuit diagram of a motorized window shade having a speed varying device.
Figure 17E:
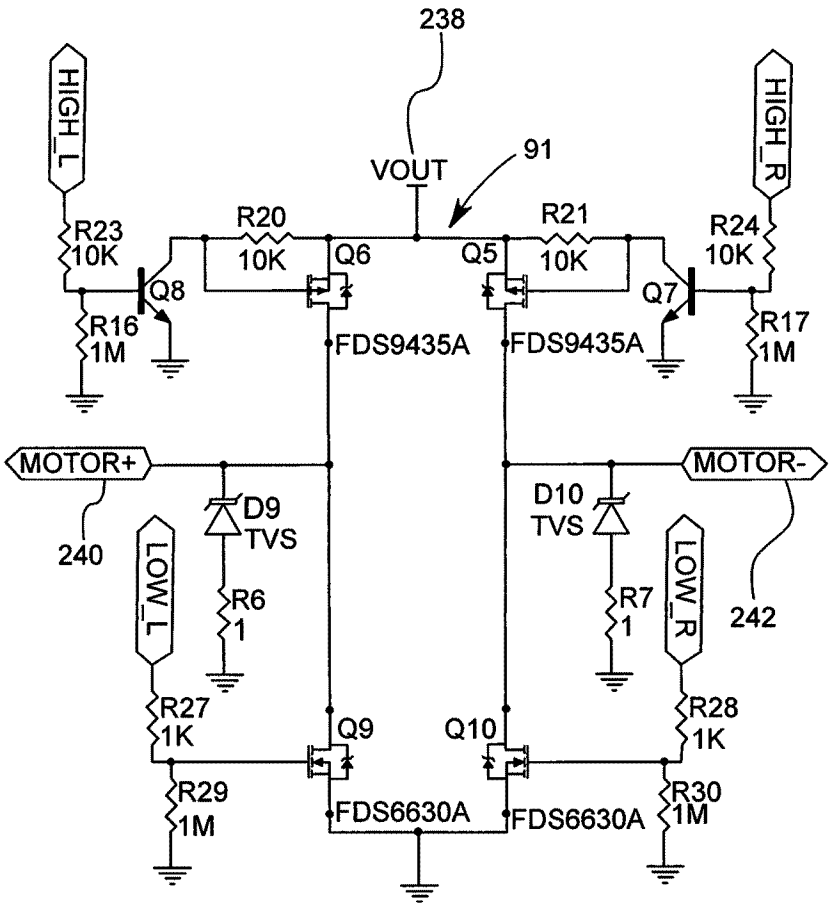
FIG. 17E is a plan schematic view of a portion of a circuit diagram of a motorized window shade having a speed varying device.

With reference to FIG. 16, a plan schematic view of a motorized window shade 12 is presented which is similar to that of FIG. 13, however this arrangement includes a speed varying device 200 is electrically connected to the microprocessor 88, memory 90 and motor 76. In the arrangement shown, as one example, speed varying device 200 is positioned between microprocessor 88 and memory 90 on one side and motor drive circuit 91 on the other side. However any operable connection between microprocessor 88 and motor 76 is hereby contemplated for use. In addition, it is hereby contemplated that motor drive circuit 91 may be positioned on either side of speed varying device 200, or connected to speed varying device 200 in any operable manner. Or in yet another embodiment, as another example motor drive circuit 91 is not present. Note, the term "microprocessor" as used herein is to be broadly described and is intended to mean the processing device or processing system for the motorized window shade 12 and may be formed of one or many devices that are combined or connected in any way to provide the effective processing and function for the motorized window shade 12. Similarly, the term "memory" as used herein is to be broadly described and is intended to mean the memory device or storage device for software or instructions for the motorized window shade 12 and may be formed of one or many devices that are combined or connected with the microprocessor to provide the effective instructions and function for the motorized window shade 12. While FIG. 16 shows a direct connection between microprocessor 88 and memory 90 and speed varying device 200, this is just one example and there may be multiple interconnections with these and other devices on the PCB 74.

In the arrangement shown in FIG. 16, power is provided by line-in cable 22/60 to provide hardwired unlimited power to motorized window shade 12. In alternative embodiment, power is provided by one or more batteries 202 (not shown) that replace what is shown as "line" 22/60 shown in FIG. 13 and FIG. 16. By replacing "line" 22/60 with batteries 202 this changes motorized window shade 12 from a hardwired powered motorized window shade 12 to a battery powered motorized window shade 12.

Speed varying device 200 varies the speed of motor 76 by any manner, method or means In one arrangement, speed varying device 204 modifies the operating speed of motor 76 by adjusting the voltage that comes into motor 76 and/or motor drive circuit 91. The higher the incoming voltage the faster the operating speed of motor 76; the lower the incoming voltage the slower the operating speed of motor 76. In one arrangement, speed varying device 204 includes a potentiometer or a digital potentiometer that controls the voltage input into motor 76. To accomplish this, in one arrangement, as is shown, speed varying device 200 includes a value table 204 that includes a plurality of values 206. These values 206 correspond to a resistance, or a relative resistance, that is output.

Any number of values 206 are hereby contemplated for use in value table 204 and range from a minimum value 208 to a maximum value 210. The minimum value 208 corresponds to a minimum resistance which corresponds to a maximum voltage which corresponds to a maximum motor speed. The maximum value 210 corresponds to a maximum resistance which corresponds to a minimum voltage which corresponds to a minimum motor speed. In one arrangement, speed varying device 200 starts with an initial setting 212, which in one arrangement, as is shown, is positioned approximately in the middle between minimum value 208 and maximum value 210. Positioning initial setting 212 at or approximately at the middle of value table 204 enables adjustment of the speed of motorized window shade 12 in either direction, faster or slower, by selecting the appropriate value 206. If it is desired to increase the speed of the motorized window shade 12, a value closer to minimum value 208 is selected which reduces the resistance of output of speed varying device 200 which increases the voltage to motor 76 which increases the speed of motor 76. If it is desired to decrease the speed of the motorized window shade 12, a value closer to maximum value 210 is selected which increases the resistance of output of speed varying device 200 which reduces the voltage to motor 76 which decreases the speed of motor 76. By positioning initial setting 212 at the middle of value table 204 this allows for adjustment both up and down.

Figure 18:
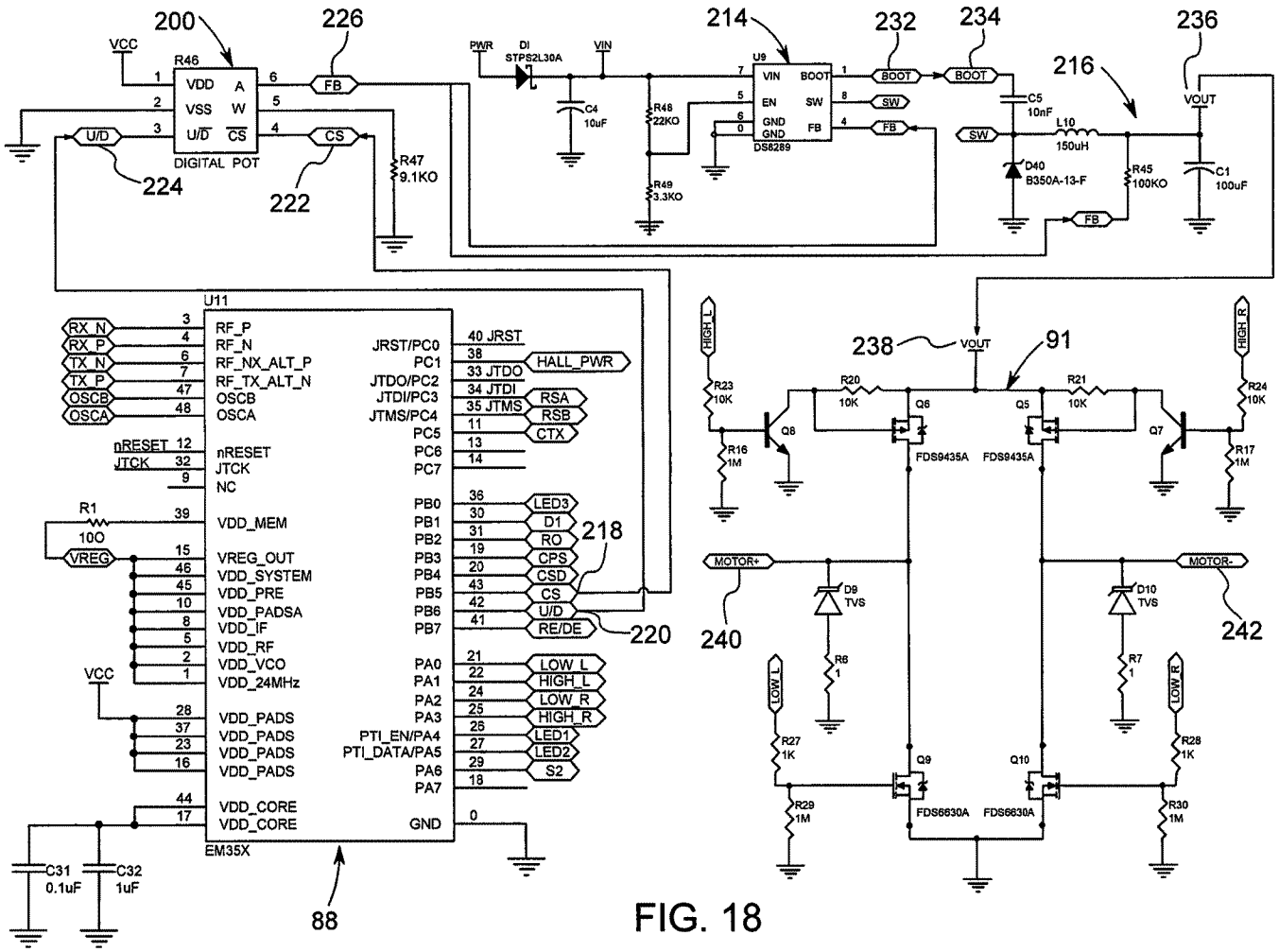
FIG. 18 is close-up plan schematic view of a circuit diagram of a motorized window shade having a speed varying device, the view showing the microprocessor, speed varying device, step down converter, filter and motor drive circuit.
Figure 19:
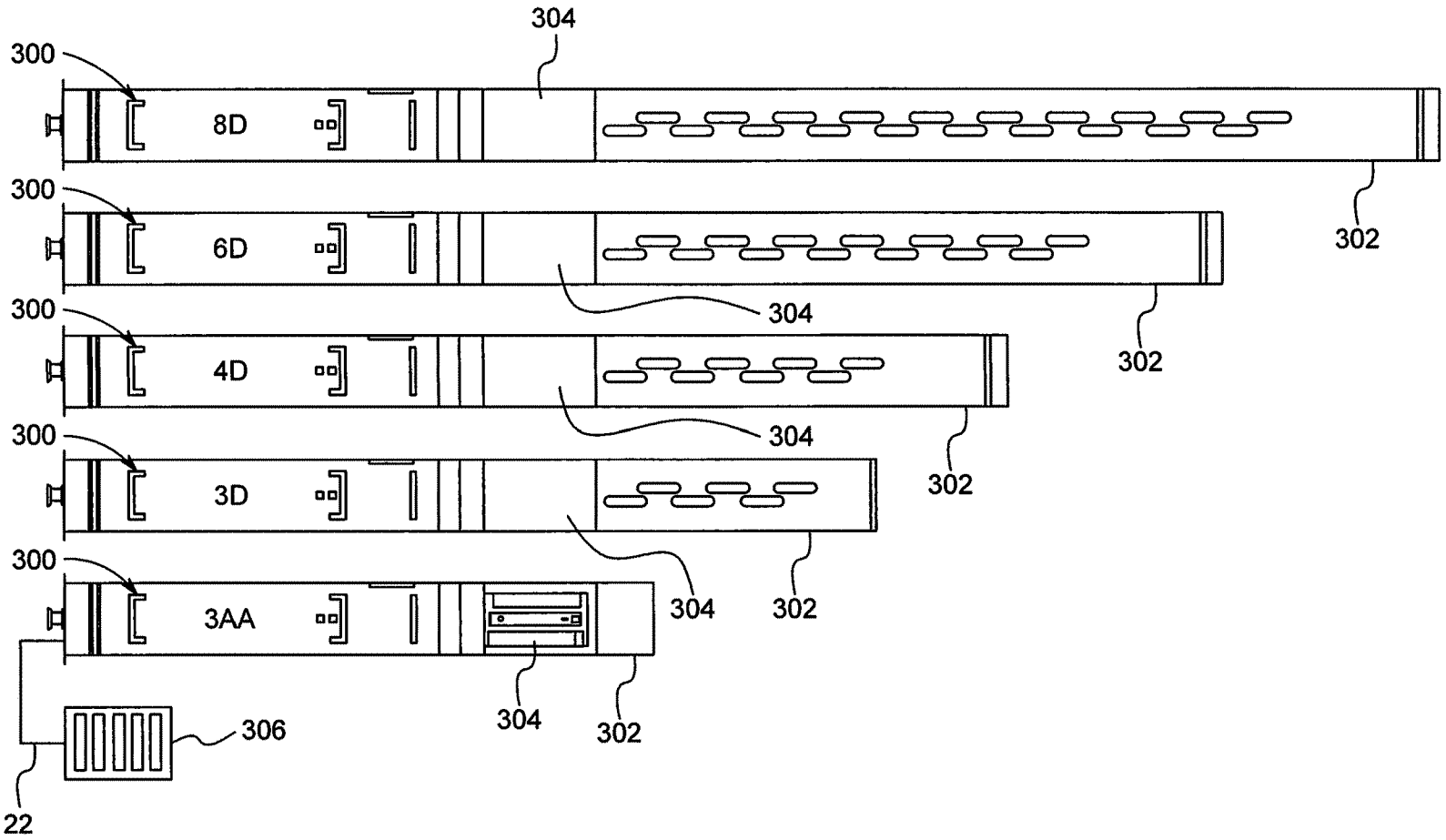
FIG. 19 is an elevation view of a plurality of battery powered motor controller assemblies, the view also showing the attachment of a solar cell to one of the battery powered motor controller assemblies as one option for external power

With reference to FIG. 17 and FIG. 18, one example of a circuit diagram for motorized window shade 12 is presented. In this arrangement, microprocessor 88, speed varying device 200, step down converter 214, filter 216 and motor drive circuit 91 are presented.

As is stated herein, microprocessor 88 is any form of a processing device which controls operation of motorized window shade 12. In the arrangement shown, microprocessor 88 includes a pair of communication channels 218 and 220 that are connected with communication channels 222 and 224 of speed varying device 200. In the arrangement shown, the communication channel 218 of microprocessor 88 designated "CS" is electrically connected to the communication channel 222 of speed varying device 200 which is similarly designated "CS". Similarly, in the arrangement shown, the communication channel 220 of microprocessor 88 designated "U/D" is electrically connected to the communication channel 224 of speed varying device 200 which is similarly designated "U/D". In this way, microprocessor 88 is electrically connected to speed varying device 200 such that microprocessor 88 can select and change the current value 206 in value table 204 of speed varying device 200.

The selected value 206 of speed varying device 200 corresponds with an output value, which in one arrangement is a resistance value (which in one arrangement is measured in ohms). This resistance value is output through communication line 226 of speed varying device 200 designated "FB". In the arrangement shown, communication line 226 of speed varying device 200 designated "FB" is electrically connected to communication line 228 of step down converter 214 which is similarly designated "FB". In the arrangement shown, communication line 226 of speed varying device 200 designated "FB" is also electrically connected to communication line 230 of filter 216 which is similarly designated "FB".

Step down converter 214 serves as the power distribution and conversion system for the motorized window shade 12. The step down converter 214 receives the selected resistance value 206 from the speed varying device 200 and outputs a corresponding voltage through communication line 232 designated "BOOT". Communication line 232 designated "BOOT" of step down converter 214 is electrically connected to communication line 234 of filter 216. Filter 216 serves to filter, clean and smooth out electrical signals, current and or voltage that pass through filter 216.

The communication line 236 designated "VOUT" of filter 216 is electrically connected to the communication line 238 of motor drive circuit 91. In this way, through the connection between communication line 236 of filter 216 to communication line 238 of motor drive circuit 92, filter 216 provides filter power from step down converter 214 that corresponds to the resistance value 206 of speed varying device 200 as selected out of value table 204 by microprocessor 88. Motor drive circuit 91 distributes this power to motor 76 through communication line 240, designated "MOTOR+" and communication line 242, designated "MOTOR−". Communication line 240, designated "MOTOR+" electrically connects to the positive terminal of motor 76. Similarly, communication line 242, designated "MOTOR−" electrically connects to the negative terminal of motor 76. Through the "H-Bridge" configuration of motor drive circuit 91, the motor drive circuit 91 controls the direction of rotation of motor 76, either raising or lowing shade material 34. The speed at which motor drive circuit 91 raises or lowers shade material 34 is determined by the amount of power, or voltage provided, which corresponds to the value 206 selected from value table 204 of speed varying device. Or, said another way, the speed at which motor drive circuit 91 raises or lowers shade material 34 is determined by the resistance value provided by speed control device 200.

FIG. 18 is a close up view of the microprocessor 88, speed varying device 200, step down converter 214, filter 216 and motor drive circuit 91. FIG. 18 depicts the electrical connections between these components.

In Operation—How to Vary the Speed: In the arrangement shown, speed varying device 200 begins with an initial setting 212 from value table 204. This causes motorized window shade 12 to operate at its initial or normal operating speed. In the event that the initial operating speed is un acceptable, and it is desired to increase or decrease the operating speed of motorized window shade 12, a different value 206 is selected from value table 204 of speed varying device.

A new value 206 is selected from value table 204 of speed varying device 200 by any manner, method or means. In one arrangement a wireless control 18 is used; whereas in another arrangement a hardwired control 16 is used.

In the event a wireless control 18 is used, such as a remote control or another computer or computing device that is wirelessly connected to motorized window shade 12 such as a computer, cell phone, smart phone, gateway, wireless router, or the like, wireless control 18 transmits wireless signals which are received by antenna 62, transmitted to radio 92 which are transmitted to microprocessor 88.

In the event a hardwired control 16 is used, that is connected to motorized window shade 12 through a hardwired connection such as line 22/60, such as a computer, cell phone, smart phone, gateway, router, or the like hardwired-connected device, hardwired control 16 transmits control signals which are received through wired connection to microprocessor 88.

Regardless whether a wireless control 18 or a wired control 16 is used, according to the protocol of motorized window shade 12, microprocessor 88 is controlled to select a new value 206 of value table 204 of speed varying device 200 through communication lines 218 and 220 that connect with communication lines 222 and 224 of speed varying device 200. Once selected, speed varying device 200 outputs a new resistance value through communication line 226 to step down converter 214 and filter 216. Step down converter 214 outputs power, or voltage, through communication line 232 to filter 216 which outputs it through communication line 236 to motor drive circuit 91.

In the event that greater speed is desired, a lower value 206 is selected that corresponds with a lower resistance which increases the speed of motor 76. In the event that a slower speed is desired, a higher value 206 is selected that corresponds with a higher resistance which reduces the speed of motor 76.

This process is repeated for each motorized window shade 12 until all motorized window shades 12 run at the desired speed.

In Operation—Wireless and Wired Control:

Motorized window shade(s) 12 which are part of the system 10 provide the advantage of being controlled through hardwired control 16, which provides its own unique advantages such as ensuring that signals are not missed due to the fact that they are piped directly into the microprocessor 88, as well as being simultaneously controllable through wireless control 18 which has a high level of reliability due to the use of gateway 20 and the handshake confirmation two-way communication protocol which provides the advantage of using a wireless control 18 which many consumers prefer. In addition, hardwired control 16 is preferable in large systems, such as large buildings where a wireless control 18 cannot be practically used to control all motorized window shades 12 simultaneously.

Utilizing Motorized Window Shades as an Alarm:

As is described herein, a network or system 10 is provided that includes a plurality of motorized window shades 12 that are capable of two-way communication. That is, the motorized window shades 12 of system 10 include both the ability to receive wireless control signals (as well as in some cases wired control signals through cable 22) as well as transmit wireless control signals (as well as in some cases wired control signals through cable 22). Security systems are designed to detect unanticipated or unexpected events such as when a break-in has occurred, or when occupants are present within a home or building who should not be there. To do so, security systems employ a wide variety of sensors to detect unexpected events or occupants, such as motion sensors, glass break sensors, door opening sensors, noise sensors, smoke detectors and the like. It should be noted that alarm system 314 may be merely an application or app electronically connected with the system 10 or network presented herein. Alternatively, alarm system 314 may be a stand-alone electronic device, or plurality of stand-alone electronic devices electronically, or a combination of an application or software and electronic devices, that connected to system 10. Alternatively, alarm system 314 may be formed as part of or a feature of home automation system 126.

In the system presented, motorized window shades 12, whether hardwired and connected via cable 22 or whether wireless and battery powered, are essentially sensors in and of themselves that are positioned at potential entry points into a building (e.g. windows). These sensors can detect, and report, the occurrence of a number of events. When these events are unexpected, their occurrence can be used to detect a break-in or unanticipated occupants or unexpected events within a home or building through the use of alarm system 314.

In one arrangement, an alarm system 314 is electronically connected to the system 10, either by direct wiring or wirelessly, or even through the internet. Alarm system 314 includes a plurality of security settings. When a manual movement of a motorized window shade 12 occurs, a signal is transmitted to alarm system 314 indicating that a manual movement occurred. If the alarm system 314 is set to a setting where the motorized window shade 12 should not be manually moved, the alarm system 314 determines that an unexpected event or break-in has occurred or that an unanticipated occupant is within the property. This may occur when someone breaks into a building through a window and accidently tugs the motorized window shade 12 as they enter through the window.

In another arrangement, when a wireless signal is transmitted by wireless control 18, a signal is transmitted to alarm system 314. If the alarm system 314 is set to a setting where a button should not be being pressed on a wireless control 18, the alarm system 314 determines that an unexpected event or a break-in has occurred or that an unanticipated occupant is within the property. Similarly, if wireless control 18 includes a motion sensor as is described herein, and the wireless control senses motion a signal is transmitted to alarm system 314. If the alarm system 314 is set to a setting where a wireless control 18 should not be experiencing motion, the alarm system 314 determines that a break-in has occurred or that an unanticipated occupant is within the property.

In yet another arrangement, when a motorized movement of one or more motorized window shades 12 occurs, a signal is transmitted to alarm system 314 indicating that a motorized movement occurred. If the alarm system 314 is set to a setting where a motorized movement should not be occurring, the alarm system 314 determines that an unexpected event or a break-in has occurred or that an unanticipated occupant is within the property.

In this way, system 10, and motorized window shades 12 are used to constantly monitor the safety and security of the property through alarm system 314 and informs the owner of the property of an unexpected event. When an unexpected movement, either manual or motorized occurs, or when an unexpected hardwired control signal is transmitted, or when an unexpected wireless signal is transmitted, such as by a button press or movement of a wireless control 18, the alarm system 314 is capable of interpreting this information and determining whether to issue an alarm based on the setting of the alarm system 314.

In operation, alarm system 314 is connected to the network of system 10 and receives information from the components of system 10, such as hardwired and battery powered motorized window shades 12. When activity occurs on the system 10, such as a wireless signal being transmitted, a hardwired signal being transmitted, a wireless control 18 detecting movement, a motorized window shade 12 being tugged, or any other activity or "indicator" as is described herein, the alarm system 314 receives this information. The alarm system 314 includes a number of security settings. When the alarm system 314 receives information that activity has occurred on the network of system 10, based on the security setting the alarm system 10 is in, the alarm system 314 interprets the indication of activity and determines whether to issue an alarm. When unexpected activity is detected by alarm system 314, the alarm system 314 transmits an alarm signal, which may be any or all of the following: an audible and/or visible alarm at the property where the motorized window shades 12 are installed, a signal transmitted to the cell phone or other electronic device of the owner/user of the system 10 such as a text message, a phone call, an audible message or the like, an email to the owner/user of the system 10, an alarm signal to emergency services, such as 911, the local police or fire department, or the like.

In this way, motorized window shades 12 are utilized to protect the safety and security of the building in which they are installed.

Accordingly, from the above discussion it will be appreciated that the improved motorized window shade system and method of use improves upon the present state of the art; that allows for adjusting the opening and closing speed; that facilitates balancing the speed of bottom bars of multiple shades; that allows a user to speed the opening or closing speed; that allows a user to slow the opening or closing speed; that varies the opening or closing speed in an efficient manner; that allows for balancing the bottom bar speed of motorized window shades having varying widths; that allows for balancing the bottom bar speed of motorized window shades having varying heights; that allows for balancing the bottom bar speed of motorized window shades having varying gear ratios; that allows for balancing the bottom bar speed of motorized window shades having varying motors; that allows for balancing the bottom bar speed of motorized window shades having varying power sources; that allows for balancing the bottom bar speed of motorized window shades without substantially reducing battery life; provides some of the advantages hardwired motorized window shades and some of the advantages of battery powered window shades while not suffering from some of the disadvantages of hardwired motorized window shades and some of the disadvantages of battery powered window shades; allows for hardwired control as well as wireless control; allows for manual movement of the shade; is relatively inexpensive; reduces or eliminates missed wireless control signals; is easy to use; is convenient to use; is easy to install; is energy efficient; has a simple design; allows for power and control signals to be transmitted through a single cable; uses standard wiring; uses standard connections; has a rugged design; allows for use of a wireless control as well as a hardwired control; has an intuitive design; reduces the cost of installation over standard hardwired shades; can be controlled through the internet; can be connected to a security system or home automation system; provides two-way wireless communication, among countless other improvements and advantages.

It will be appreciated by those skilled in the art that other various modifications could be made to the device without parting from the spirit and scope of this invention. All such modifications and changes fall within the scope of the claims and are intended to be covered thereby.

What is claimed:

1. A motorized window shade system, comprising:

a power panel;

wherein the power panel is configured to electrically connect to a plurality of motorized window shades;

a hardwired control;

a wireless control;

a gateway;

the gateway having an antenna, a radio, a microprocessor and memory;

a first motorized window shade;

the first motorized window shade having a motor controller assembly;

the motor controller assembly of the first motorized window shade having a motor, an antenna, a radio, a microprocessor and memory;

the motor controller assembly of the first motorized window shade has an electrical connection electrically connected to the power panel and the hardwired control;

the motor controller assembly of the first motorized window shade wirelessly connected to the wireless control;

wherein the motor controller assembly of the first motorized window shade receives control signals from the hardwired control through the electrical connection to the hardwired control;

wherein the motor controller assembly of the first motorized window shade receives power through the electrical connection to the power panel;

wherein the motor controller assembly of the first motorized window shade receives control signals from the wireless control through a wireless connection to the wireless control;

a second motorized window shade;

the second motorized window shade having a motor controller assembly;

the motor controller assembly of the second motorized window shade having a motor, an antenna, a radio, a microprocessor and memory;

the motor controller assembly of the second motorized window shade wirelessly connected to the wireless control;

wherein the motor controller assembly of the second motorized window shade receives control signals from the wireless control through a wireless connection to the wireless control;

wherein the motor controller assembly of the second motorized window shade receives power from one or more batteries;

wherein the gateway is configured to continuously listen for wireless control signals transmitted by wireless control;

wherein the gateway receives control signals from the wireless control, wherein the gateway stores these control signals from the wireless control in the memory of the gateway and wherein the gateway wirelessly transmits the stored control signals upon request;

wherein the second motorized window shade periodically polls the gateway at predetermined intervals, by switching between an asleep state, to conserve battery power, and an awake state;

wherein during the awake state the second motorized window shade transmits a signal to the gateway to which the gateway provides an affirmative response, wherein the gateway responds to the second motorized window shade with one of a stored control signal or a "no" signal, wherein in response to receiving the stored control signal the second motorized window shade carries out a command of the stored control signal and in response to receiving the "no" signal the second motorized window shade goes back to the asleep state.

2. The motorized window shade system of claim 1 wherein the motor controller assembly of the first motorized window shade, the power panel and the hardwired control are each connected by a respective Ethernet cable.

3. The motorized window shade system of claim 1 wherein the motor controller assembly of the first motorized window shade, the power panel and the hardwired control are each connected by a respective multi-wire cable.

4. The motorized window shade system of claim 1 wherein the motor controller assembly of the first motorized window shade includes a socket that receives a plug connected to a multi-wire cable.

5. The motorized window shade system of claim 1 further comprising:

a third motorized window shade;

the third motorized window shade having a motor controller assembly;

the motor controller assembly of the third motorized window shade having a motor, an antenna, a radio, a microprocessor and memory;

the motor controller assembly of the third motorized window shade electrically connected to the power panel and the hardwired control;

the motor controller assembly of the third motorized window shade wirelessly connected to the wireless control;

wherein the motor controller assembly of the third motorized window shade receives control signals from the hardwired control through an electrical connection to the hardwired control;

wherein the motor controller assembly of the third motorized window shade receives control signals from the wireless control through a wireless connection to the wireless control;

wherein the motor controller assembly of the third motorized window shade receives power from one or more batteries;

wherein the third motorized window shade is configured to periodically poll the gateway at predetermined intervals, by switching between an asleep state, to conserve battery power, and an awake state;

wherein during the awake state the third motorized window shade transmits a signal to the gateway to which the gateway provides an affirmative response, wherein the gateway responds to the third motorized window shade with one of a stored control signal or a "no" signal, wherein in response to receiving the stored control signal the third motorized window shade carries out a command of the stored control signal and in response to receiving the "no" signal the third motorized window shade goes back to the asleep state.

6. The motorized window shade system of claim 1, wherein the wireless control wirelessly communicates with the gateway and the gateway wirelessly communicates with the first motorized window shade.

7. The motorized window shade system of claim 1, wherein the first motorized window shade is movable to a different position by manual movement as well as by motorized movement.

8. The motorized window shade system of claim 1, further comprising:

a respective counterbalance assembly operatively connected to each of the first motorized window shade and the B second motorized window shade, wherein each counterbalance assembly provides a counterbalance force.

* * * * *